US008403135B2

(12) United States Patent
Corry

(10) Patent No.: US 8,403,135 B2
(45) Date of Patent: Mar. 26, 2013

(54) UNIVERSAL EAR-BUD HOLDER

(76) Inventor: Charles D. Corry, Chicago, IL (US)

( * ) Notice: Subject to any disclaimer, the term of this patent is extended or adjusted under 35 U.S.C. 154(b) by 26 days.

(21) Appl. No.: 12/567,560

(22) Filed: Sep. 25, 2009

(65) Prior Publication Data

US 2010/0276315 A1 Nov. 4, 2010

Related U.S. Application Data

(60) Provisional application No. 61/174,359, filed on Apr. 30, 2009.

(51) Int. Cl.
*B65D 85/00* (2006.01)

(52) U.S. Cl. ..... 206/320

(58) Field of Classification Search ..... 206/320, 206/428, 805, 303; 248/311.2, 313; 24/3.11, 24/3.12, 3.1, 3.7; 381/322
See application file for complete search history.

(56) References Cited

U.S. PATENT DOCUMENTS

| | | | | |
|---|---|---|---|---|
| 3,561,595 | A * | 2/1971 | Weggeland | 206/757 |
| 3,632,010 | A * | 1/1972 | Marty, Sr. | 220/6 |
| 4,089,412 | A * | 5/1978 | Baugh | 206/314 |
| 5,385,282 | A * | 1/1995 | Chen | 224/669 |
| 5,697,071 | A * | 12/1997 | Fan | 455/575.9 |
| 5,790,021 | A * | 8/1998 | Mickel et al. | 340/539.32 |
| 5,839,710 | A * | 11/1998 | Hubbard | 248/311.2 |
| 5,988,577 | A * | 11/1999 | Phillips et al. | 248/231.81 |
| 6,397,046 | B1 * | 5/2002 | Kfoury | 455/90.1 |
| 6,401,253 | B2 * | 6/2002 | Brunson | 2/160 |
| 6,401,305 | B1 * | 6/2002 | Joseph | 24/16 R |
| 6,523,229 | B2 * | 2/2003 | Severson | 24/16 PB |
| 6,752,299 | B2 * | 6/2004 | Shetler et al. | 224/197 |
| 6,932,309 | B1 * | 8/2005 | Corey et al. | 248/231.9 |
| 6,981,591 | B2 * | 1/2006 | Logan | 206/451 |
| 7,619,388 | B1 * | 11/2009 | Nana | 320/114 |
| 7,648,027 | B2 * | 1/2010 | Lin et al. | 206/320 |
| 7,757,913 | B2 * | 7/2010 | Fichera | 224/197 |
| 2002/0090083 | A1 * | 7/2002 | Grant et al. | 379/454 |
| 2005/0045681 | A1 * | 3/2005 | Hancock et al. | 224/401 |

(Continued)

FOREIGN PATENT DOCUMENTS

| | | |
|---|---|---|
| DE | 296 07 310 U1 | 7/1996 |
| DE | 198 12 389 A1 | 11/1998 |

(Continued)

OTHER PUBLICATIONS

Advertisement for "Tunewear EarBud Holder" product on website http://www.pcmag.com.

(Continued)

*Primary Examiner* — Steven A. Reynolds
*Assistant Examiner* — King M Chu
(74) *Attorney, Agent, or Firm* — Chicago IP Law; Steven M. Evans

(57) ABSTRACT

An apparatus and method for retaining an ear-bud, said apparatus having a base, first and second sidewalls at opposing ends of the base forming a receptacle, a flexible member stretched around the first and second sidewalls of the base, wherein the flexible member forms a band that stretches and contracts to enable the apparatus to retain ear-buds having various configurations. The sidewalls are preferably attached to a portion of the periphery of the base, which is preferably an elongated, flat platform. The flexible member forms a band that is stretched around the sidewalls, wherein a portion of the flexible band is not connected to the sidewalls and is capable of expanding and contracting so as to receive and retain an ear-bud placed within the receptacle.

16 Claims, 28 Drawing Sheets

U.S. PATENT DOCUMENTS

| | | | | |
|---|---|---|---|---|
| 2005/0255898 | A1* | 11/2005 | Huang | 455/575.8 |
| 2006/0058070 | A1* | 3/2006 | Chang | 455/569.1 |
| 2006/0237494 | A1* | 10/2006 | Fichera | 224/197 |
| 2006/0272969 | A1* | 12/2006 | Hartstein et al. | 206/320 |
| 2007/0170332 | A1 | 7/2007 | Akerstedt et al. | |

FOREIGN PATENT DOCUMENTS

| | | | |
|---|---|---|---|
| EP | 1 803 608 | A1 | 7/2007 |

OTHER PUBLICATIONS

Advertisement for Belkin Earbud Clip for iPod (Black/Silver), by Apple Store (U.S.) at website http://store.apple.com.

Advertisement for Nylon Black Ultra Slim Hard Shell Bluetooth Carrying Case for Samsung at webpage http://www.amazon.com.

Advertisement for Bluetooth headset holder by Andi Monn at website http://www.cooldesignideasblog.net.

Advertisement for bluetooth headset leather pouches at website http://www.google.com.

Advertisement for BudFits Ipod Earbud Holder by Road Runner Sports at website http://www.cooldesignideasblog.net.

Advertisement for Fish bone Headphone Cord Smart wrap by Shenzhen Longgang Jiangzhu Silicone Rubber Products Factory at website http://www.alibaba.com.

Advertisement for What If Widgets WIWJACKRET01 earbuds JACK at website http://www.amazon.com.

Advertisement for get earbud holders by Lobie at website http://www.mylobie.com.

Advertisement for earbud holder by Naztech at website http://www.naztech.com.

Advertisement for earbud holder by Tech(ish) at website http://www.twistedsun.net.

Advertisement for bluetooth earbud holder by Newegg at http://www.newegg.com.

Advertisement for Q-Lid sports cap with iPod holder and earbud system by Strata America, Inc. at website http://www.ilounge.com.

Advertisement for Smart Wrap for iPod, by Shenzhen Longgang Jiangzhu Silicone Rubber Products Factory, at website http://szjzxj.en.alibaba.com/product/231837445-200372383/Smart__Wrap__for__iPod.html.

Advertisement for Earbud Yo-Yo by E-Gear at website http://www.e-gear.com.

Advertisement for TuneTether Earbud Holder at website http://www.bhphotovideo.com/.

Panstrong Company Ltd., "USB Dust Cover Datasheet," (May 25, 2007) Retrieved from the Internet: http://www.panstrong.com.tw/products/connector/standard-usb/acs-u*f*01.html, accessed Jun. 30, 2010.

* cited by examiner

265

UNIVERSAL EAR-BUD HOLDER

CROSS-REFERENCE TO RELATED APPLICATION

This non-provisional patent application claims priority and benefit of U.S. provisional patent application having application No. 61/174,359, filed Apr. 30, 2009, and entitled UNIVERSAL EAR-BUD HOLDER, the disclosure of which is hereby incorporated by reference in its entirety.

FIELD OF THE INVENTION

The present invention relates to retention devices for earpieces having ear-buds, and more particularly, to a device capable of holding ear-buds of multiple sizes and configurations.

BACKGROUND OF THE PRESENT INVENTION

Wireless earpieces having ear-buds for communication devices, such as Bluetooth devices, are becoming extremely popular for both business and personal use. Bluetooth devices provide short range, wireless communication between a peripheral device and a base unit. For example, Bluetooth transmissions are used to establish wireless bidirectional communication between a home computer and a keyboard or a printer. A more common use of Bluetooth communications is to establish a wireless communication between a cell phone and an earpiece or earphone for the cell phone user, thus enabling hands-free operation during a telephone conversation.

A reoccurring problem with wireless ear-buds is finding a place to store wireless ear-buds when not in use. A common technique people use during non use is to leave their ear-buds on their desks or place it in their pockets. This can result their ear-buds getting lost, dirty or broken.

Some retaining devices for ear-buds do exist, but they are specifically configured for a corresponding, unique ear-bud design. Such prior art ear-bud retaining devices are unable to accommodate ear-buds having different or varying configurations.

OBJECTS AND SUMMARY OF THE INVENTION

In view of the foregoing, an object of the present invention is to provide a universal ear-bud holder that retains different types of ear-buds having various configurations and sizes.

Another object of the present invention is to provide a universal ear-bud holder for both wired and wireless ear-buds.

A further object of the present invention is to provide a holder for hearing aids of varying configurations.

Moreover, another object of the present invention is to keep ear-buds clean, undamaged, and prevent loss during non-use.

In view of the foregoing, the present invention provides an apparatus for retaining an ear-bud, said apparatus preferably having a base, first and second sidewalls at opposing ends of the base to form a receptacle, a flexible member coupled to the first and second sidewalls of the base, wherein the flexible member forms a band that stretches and contracts to enable the apparatus to retain ear-buds having various configurations. The sidewalls are preferably rigid and attached to a portion of the periphery of the base, which is preferably an elongated, flat, rigid platform. The flexible member forms a band that is stretched around the sidewalls. A portion of the flexible band is not connected to the sidewalls and is capable of expanding to receive and contracting to retain an ear-bud placed within the receptacle.

The present invention further provides an ear-bud holding apparatus having a cylindrical plug sized to fit within an ear-phone socket of an electrical device. The cylindrical plug is constructed of non-electrically conductive material and has front and rear ends, said front end being of smaller diameter that the rear end to enable easier insertion of the front end into an ear-phone socket, and a handle attached to the rear end of the cylindrical plug for attaching a clip that holds an ear-bud holder. In an alternative embodiment, the ear-bud holding apparatus has a plug sized to fit within a USB socket of an electronic device.

Figure 5:
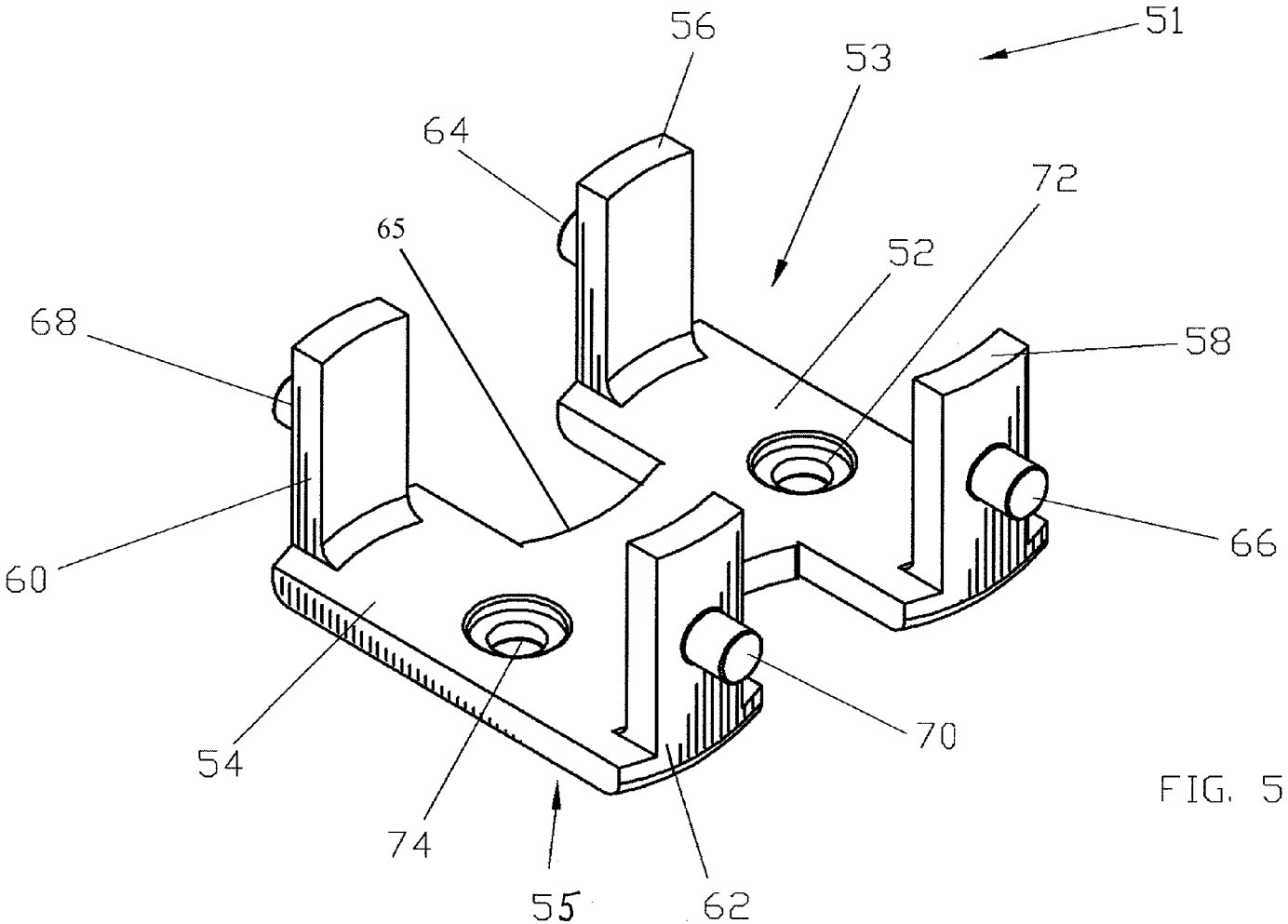
FIG. 5 is a perspective view of a base and sidewalls for a universal ear-bud holder configured accordance with a preferred embodiment of the present invention.
Figure 7A:
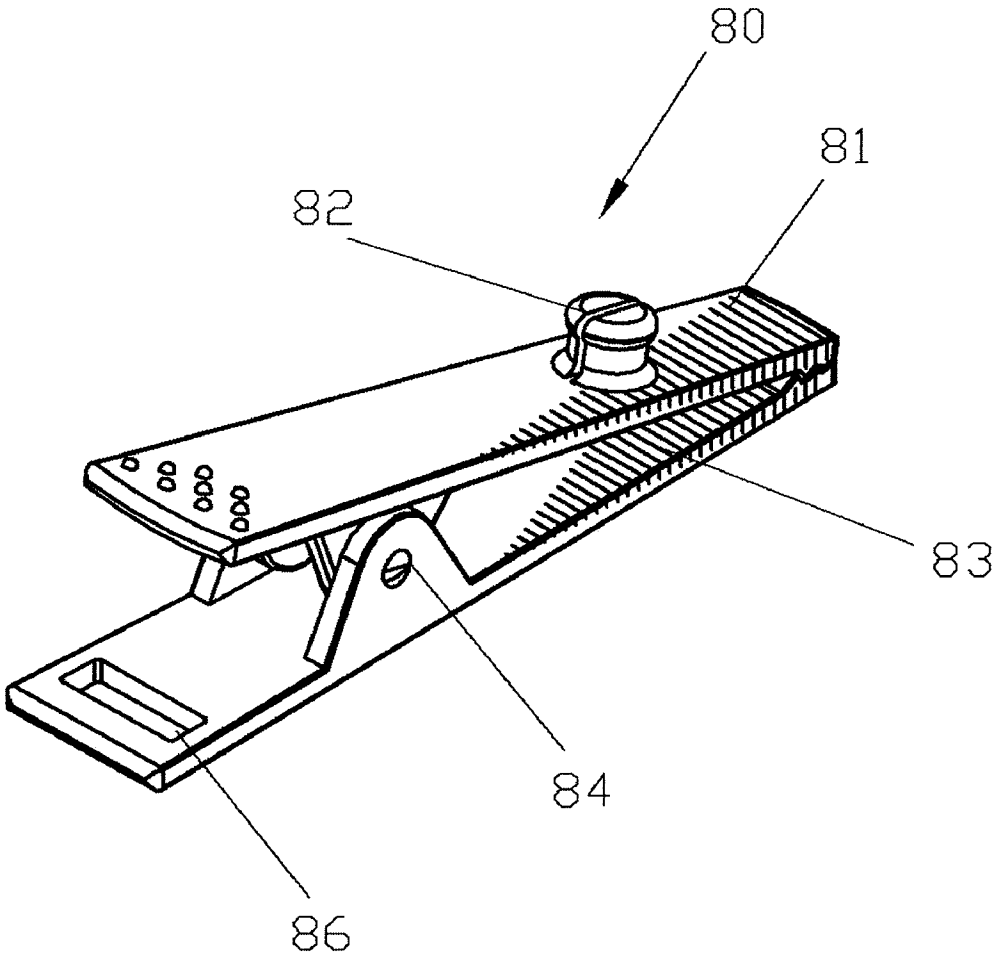
Figure 7B:
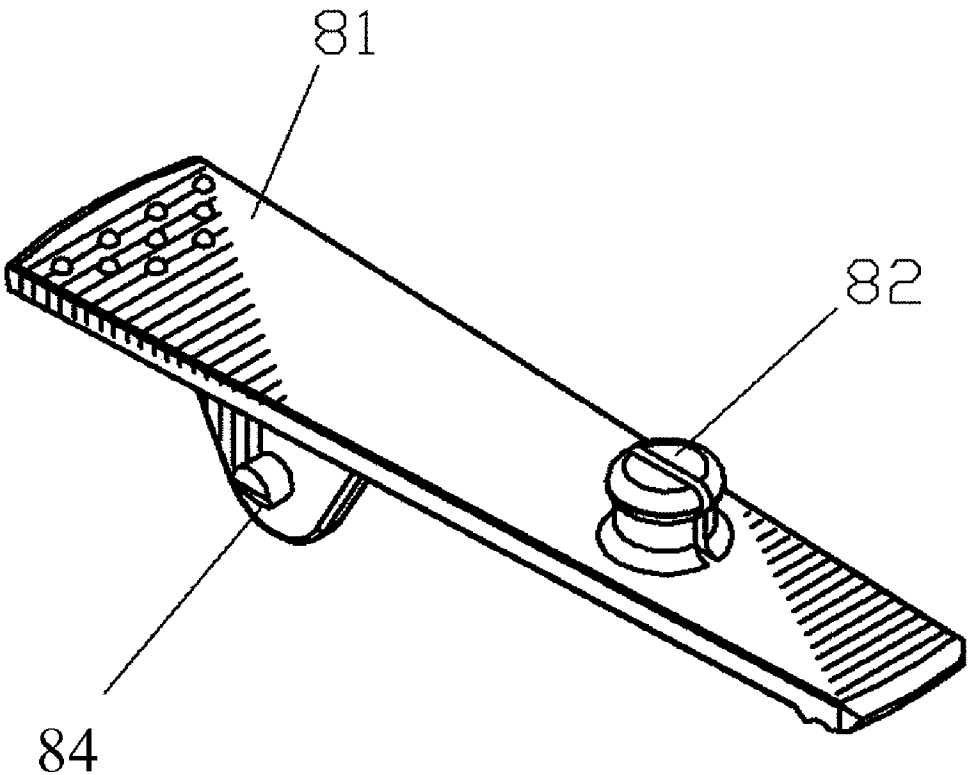
Figure 7C:
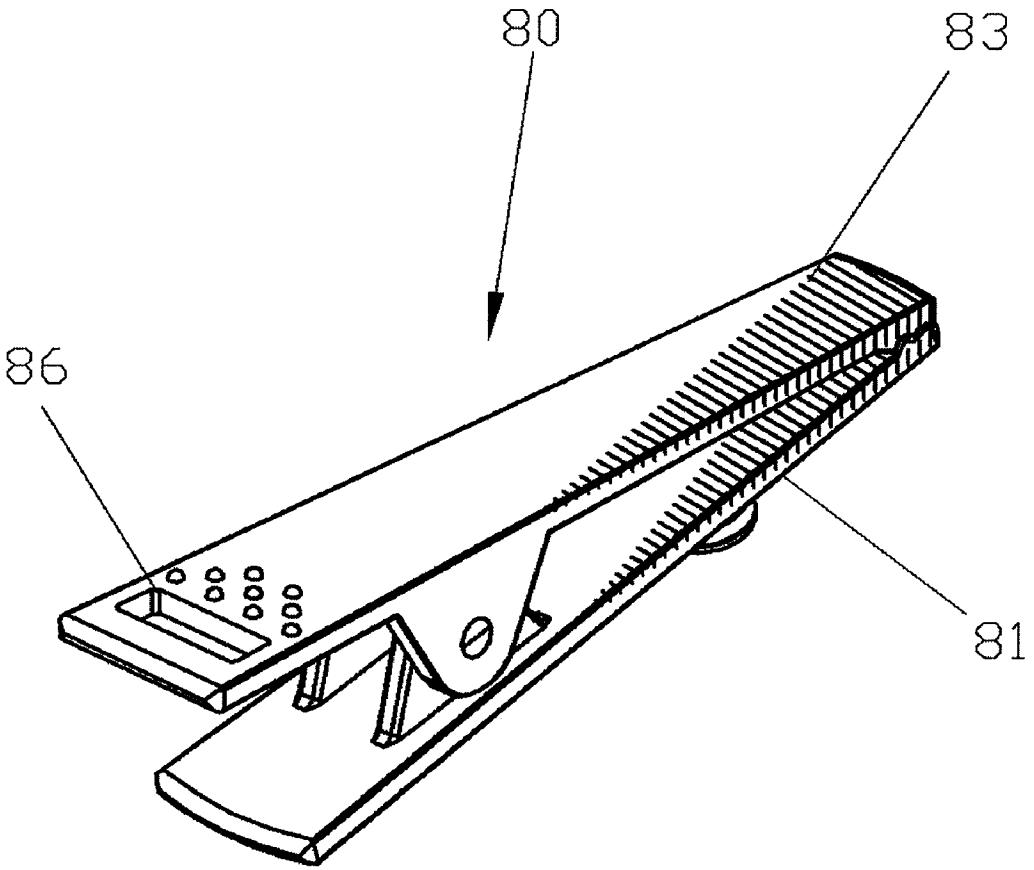
Figure 7D:
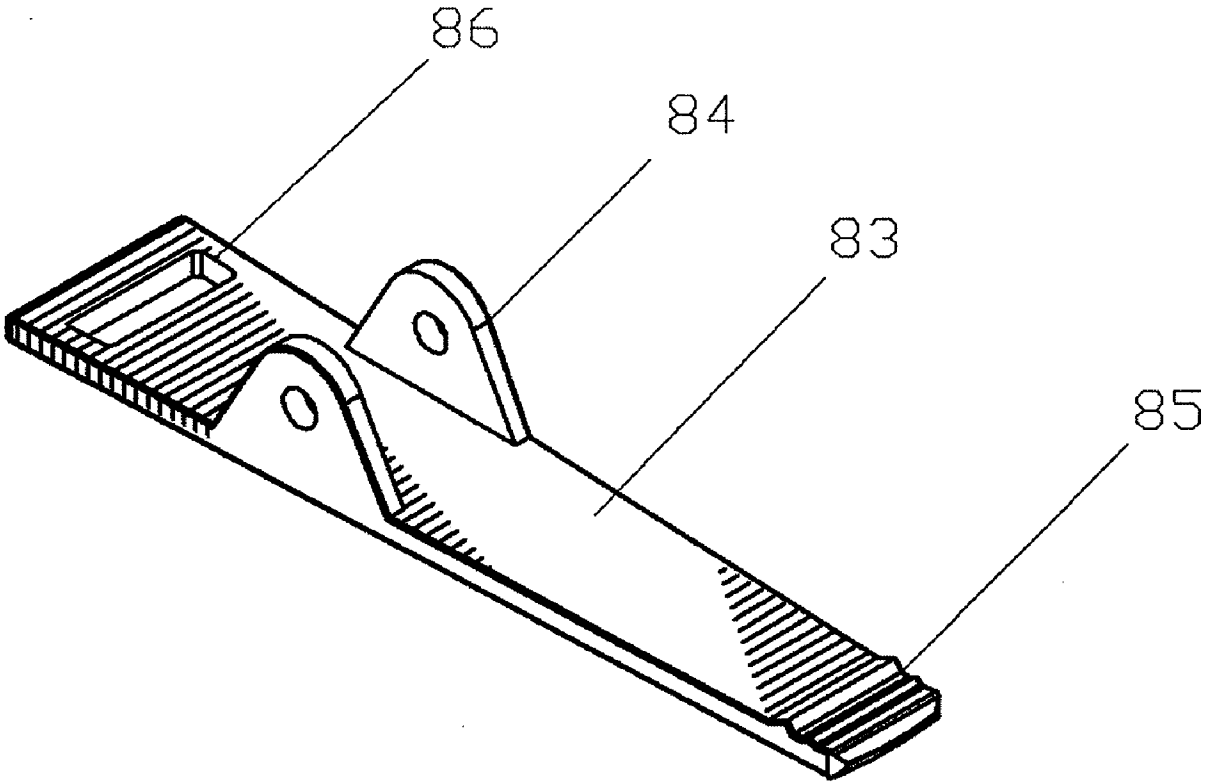
Figure 7E:
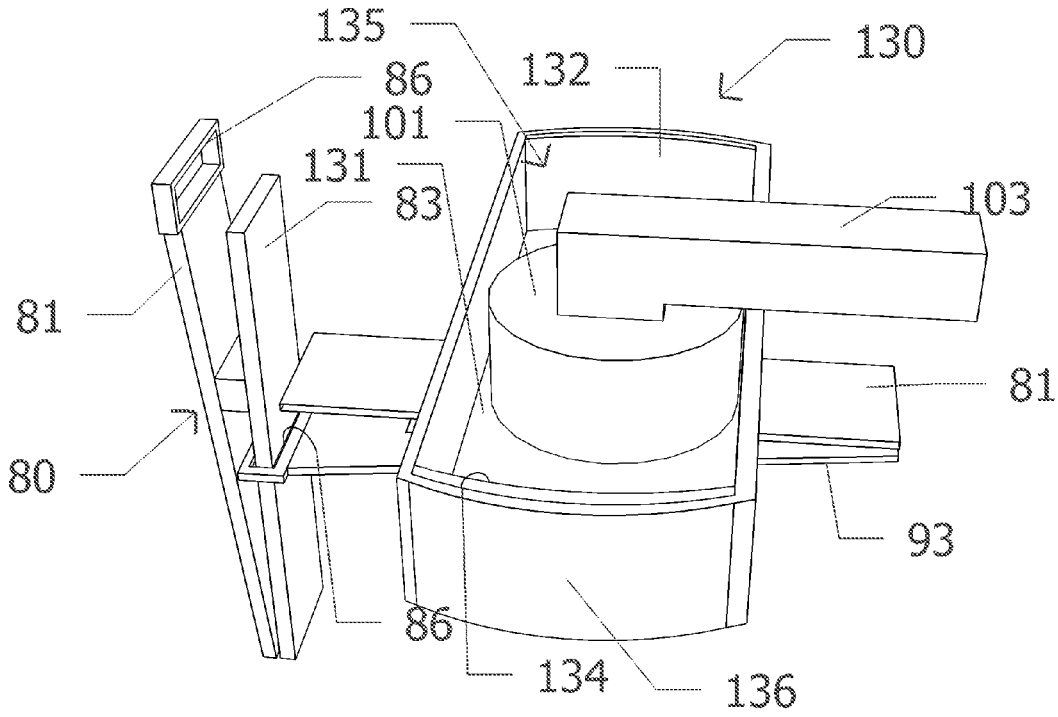
Figure 8:
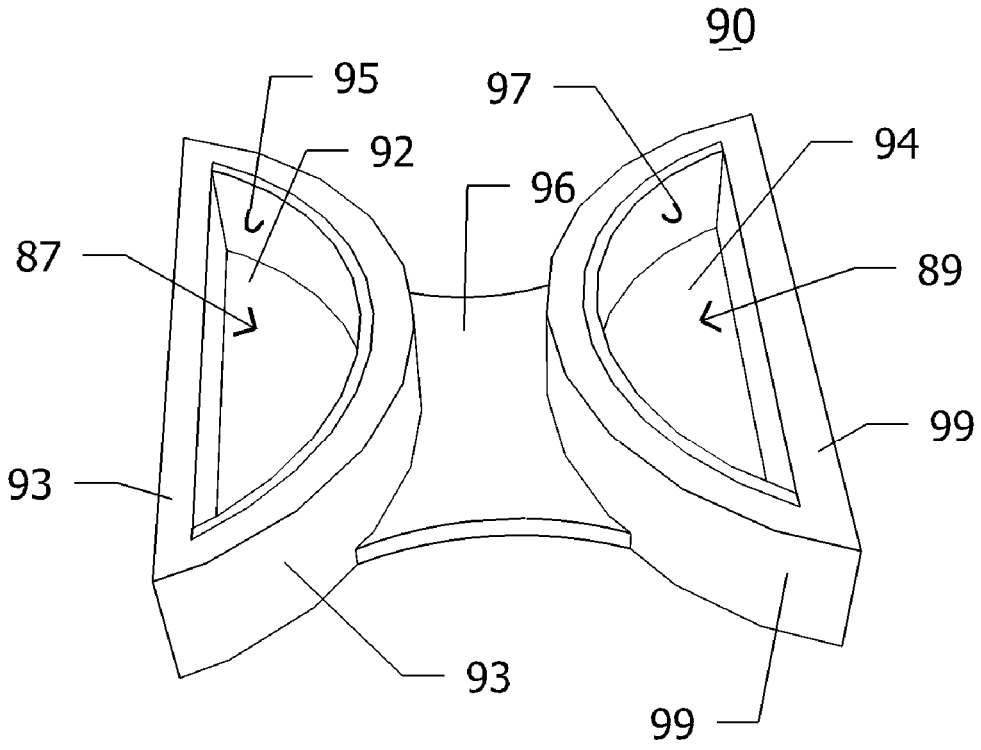
Figure 9:
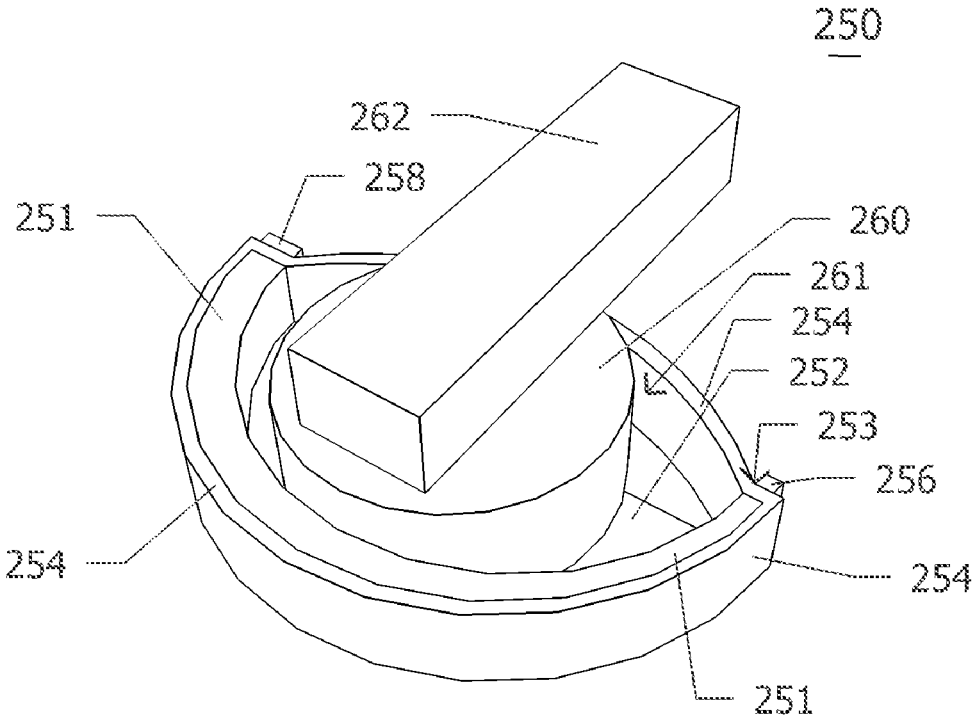
Figure 10:
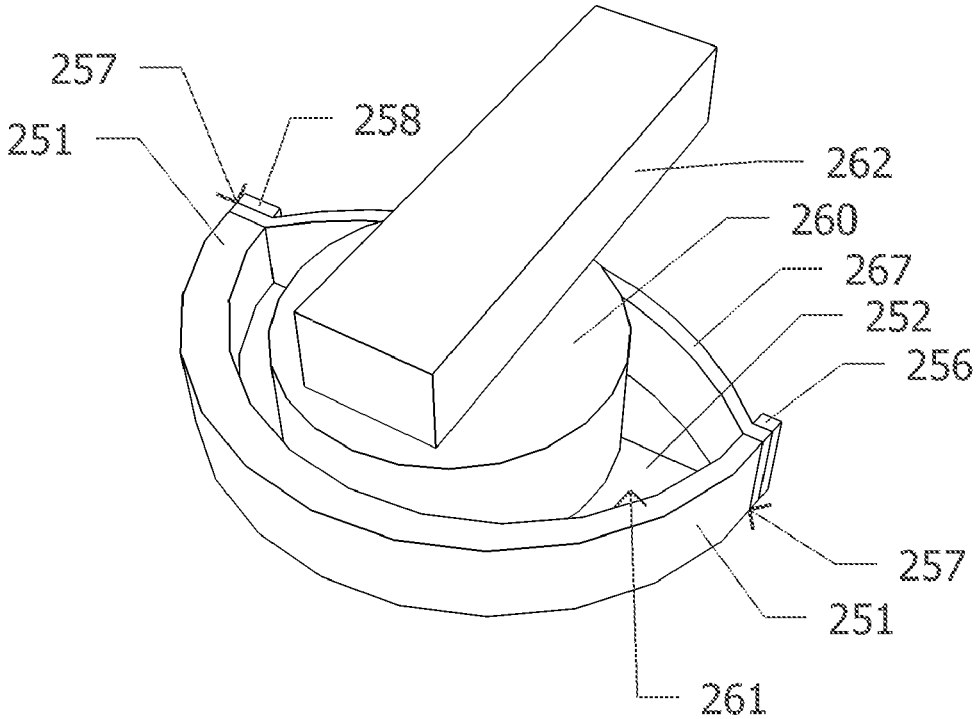
Figure 11:
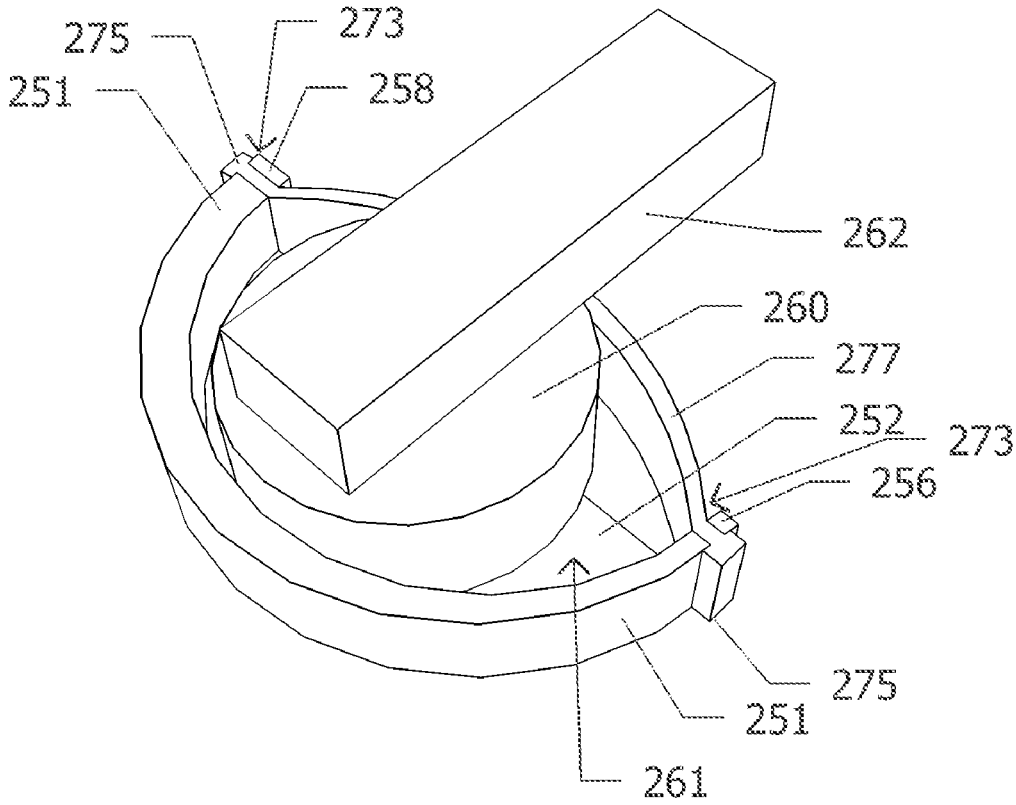
Figure 12:
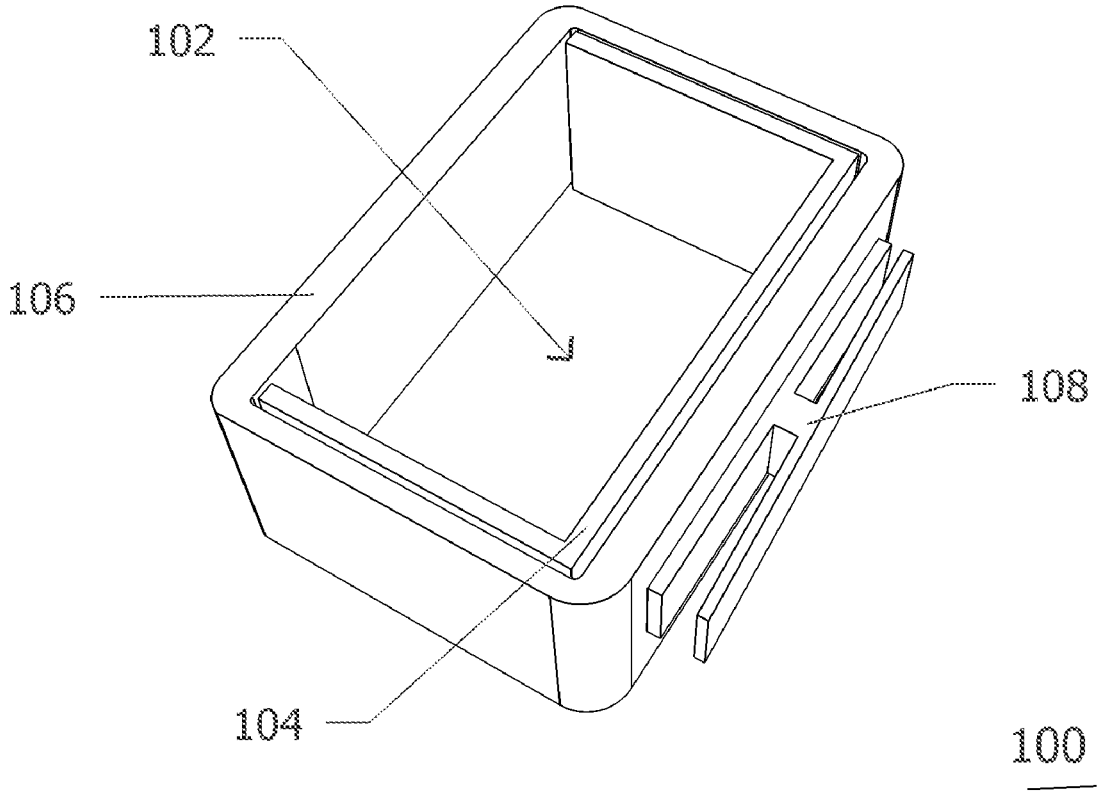
Figure 13:
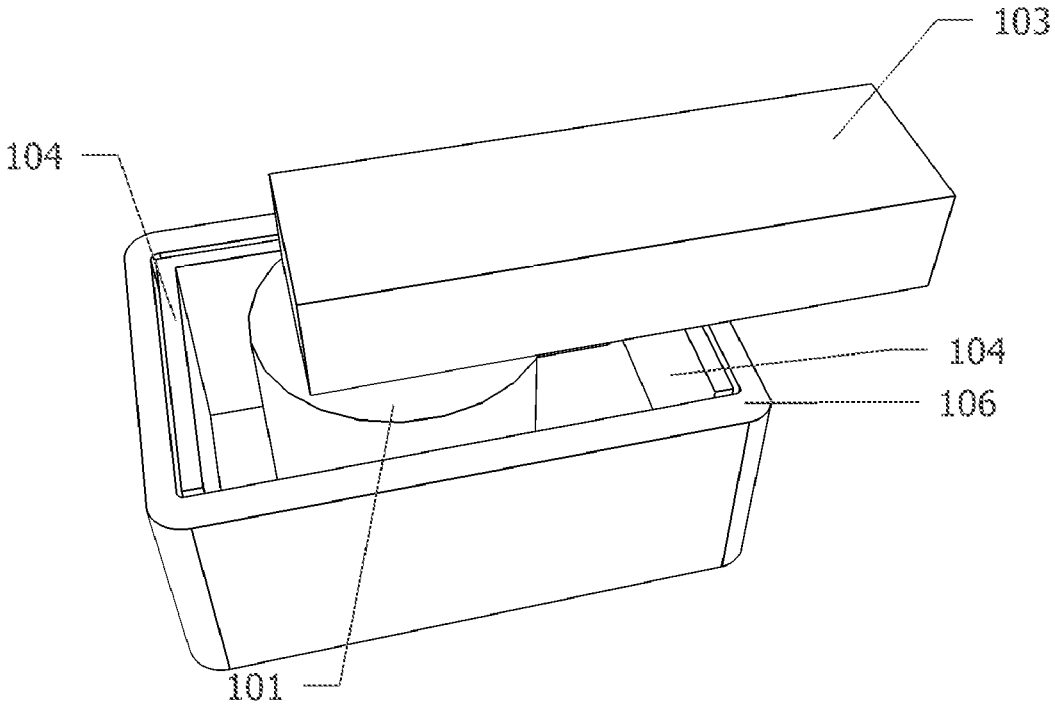
Figure 14:
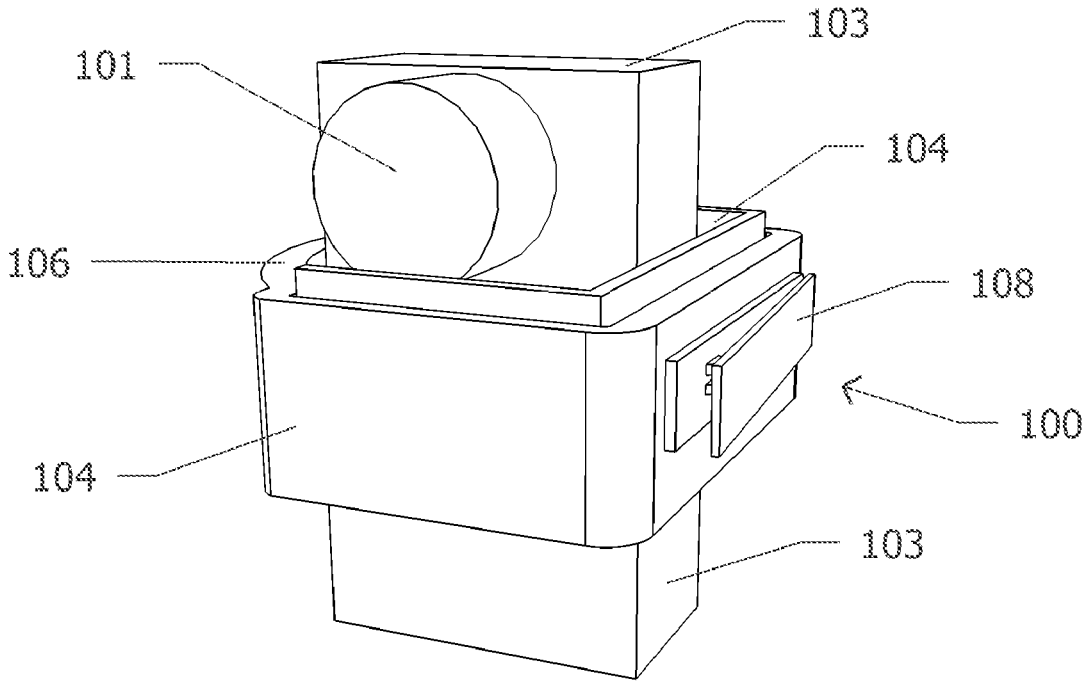
Figure 15:
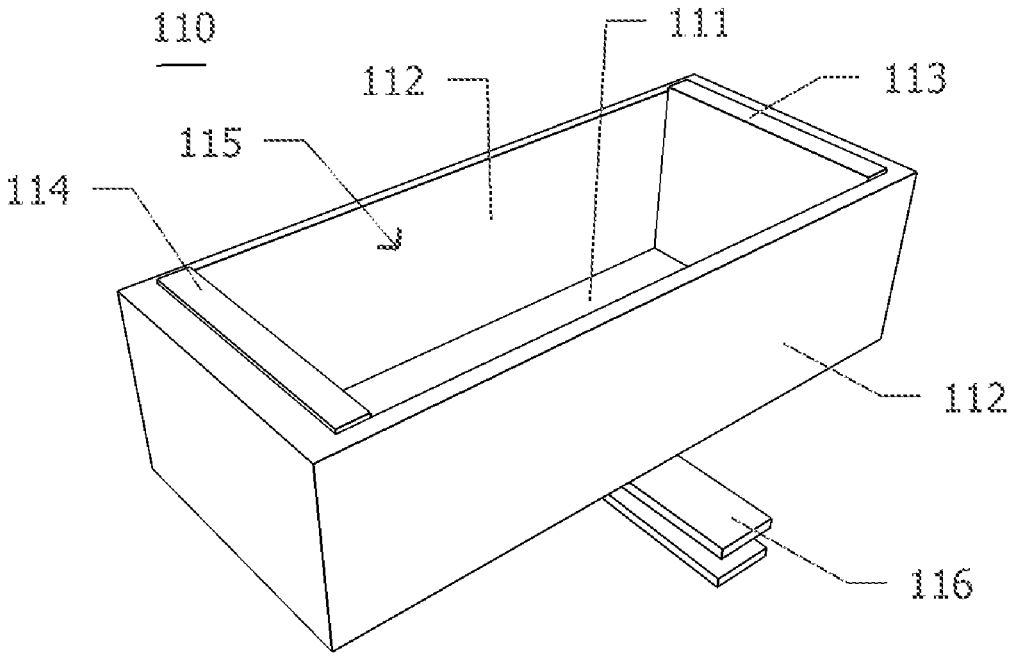
Figure 16:
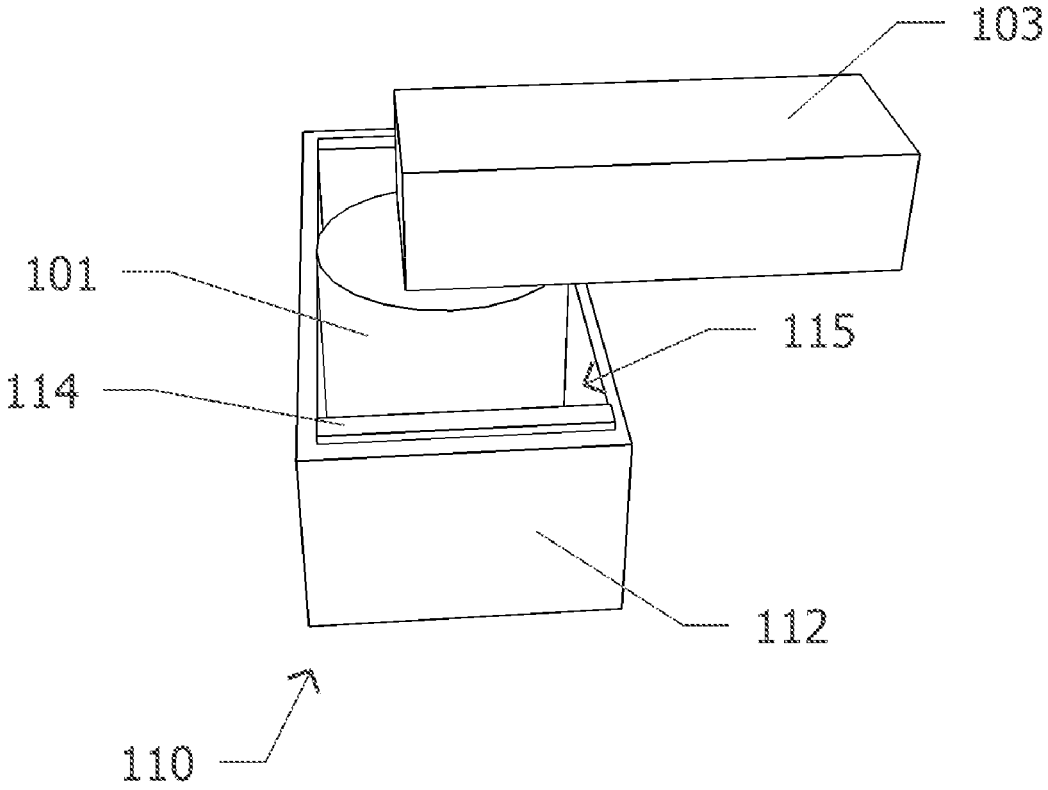
Figure 17:
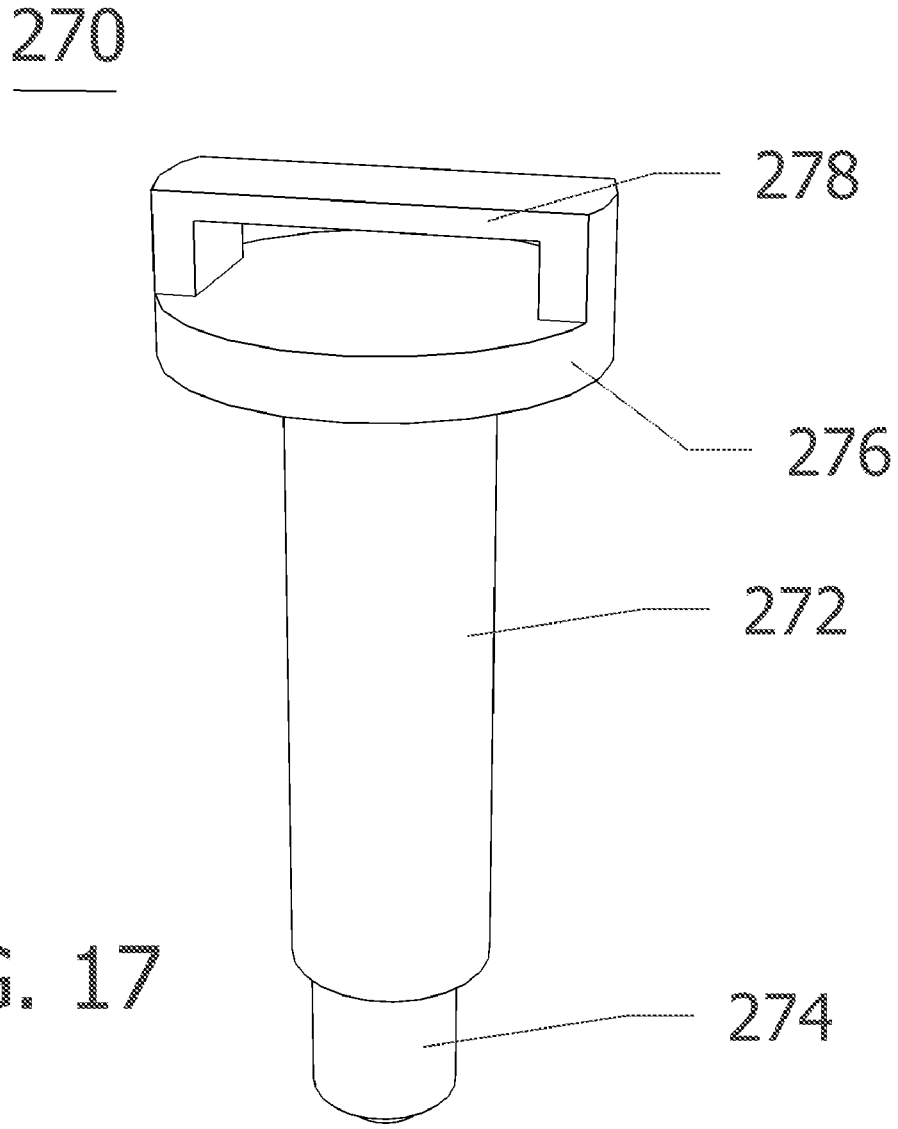
Figure 18:
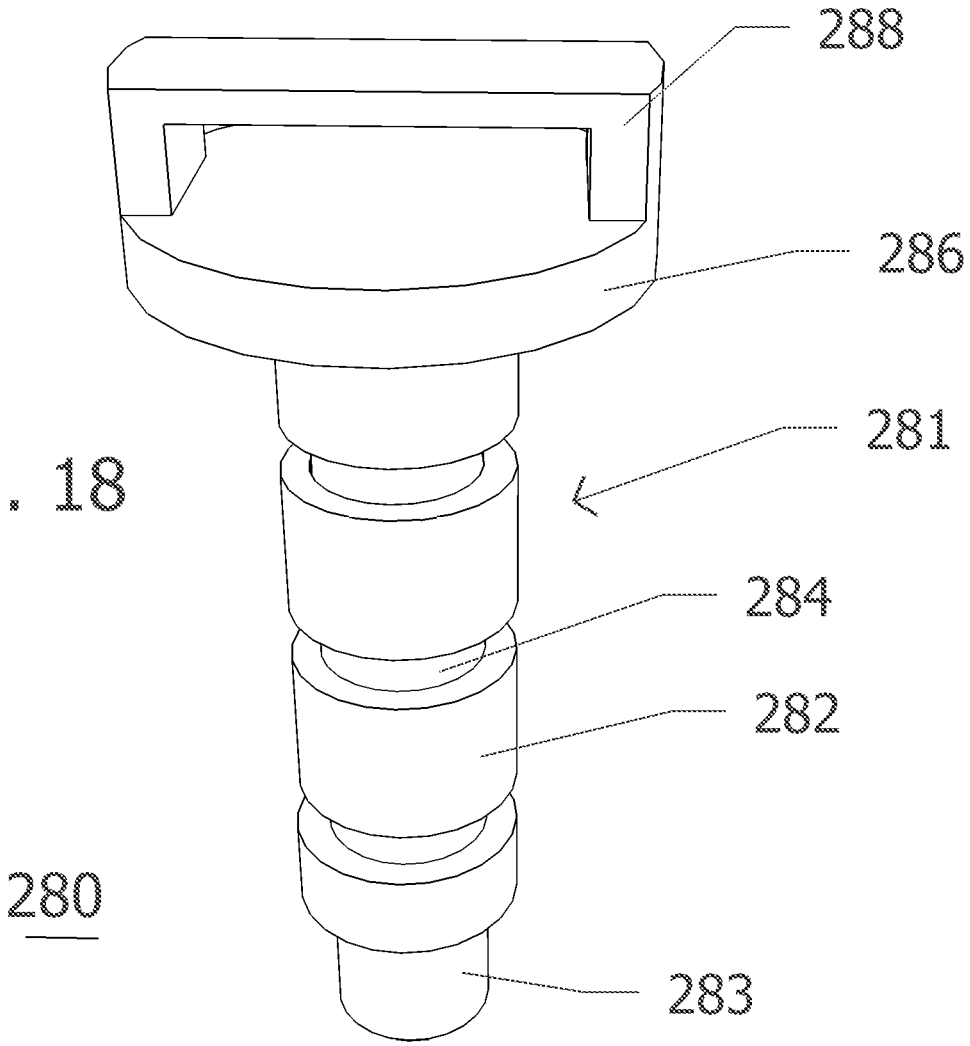
Figure 19:
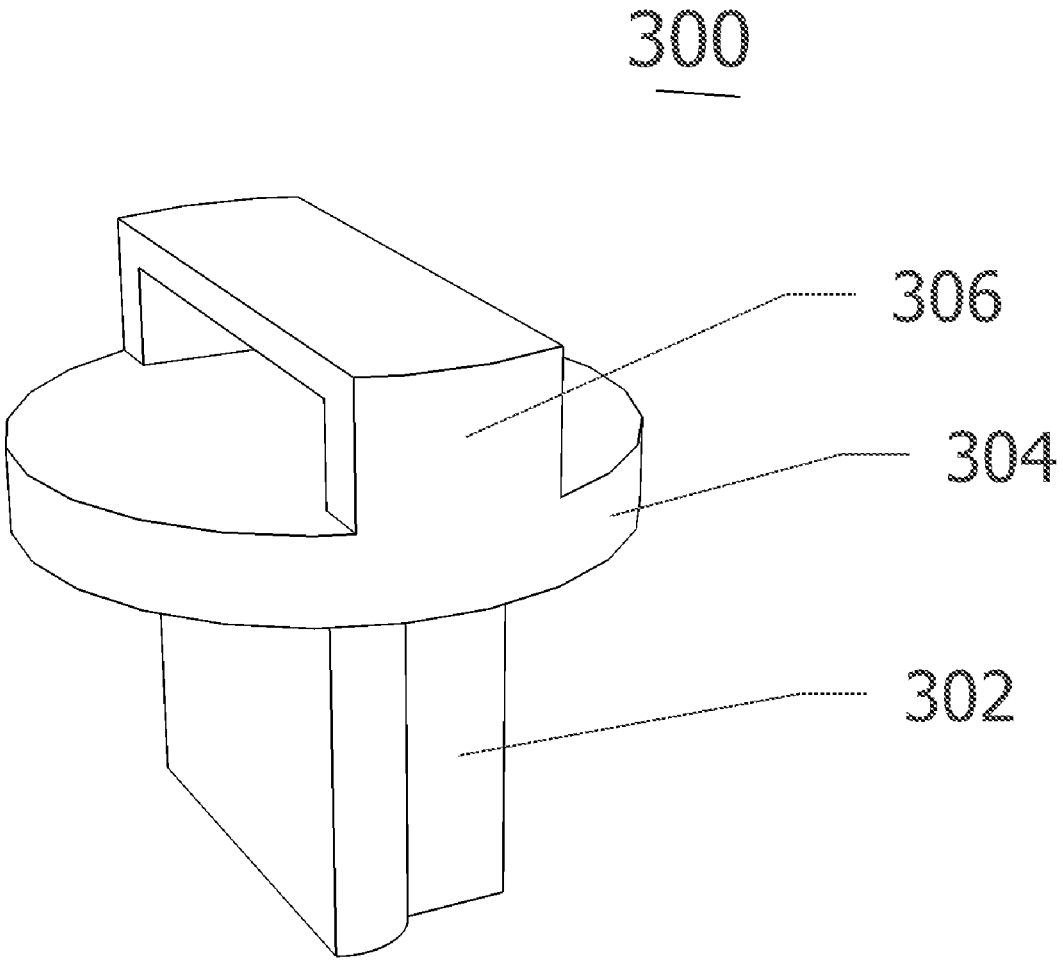
Figure 20:
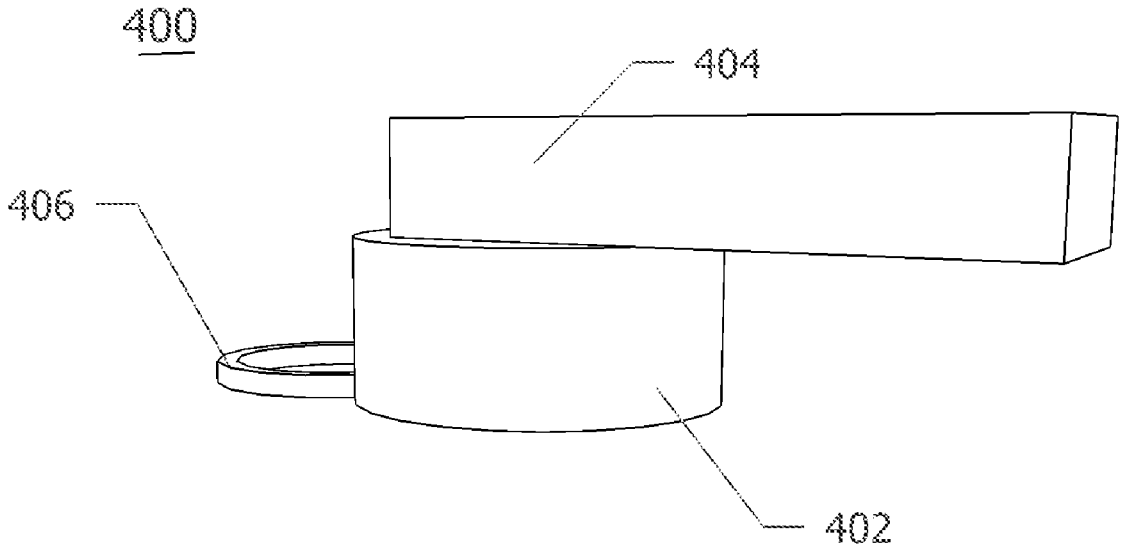
FIG. 20 (PRIOR ART)
Figure 21:
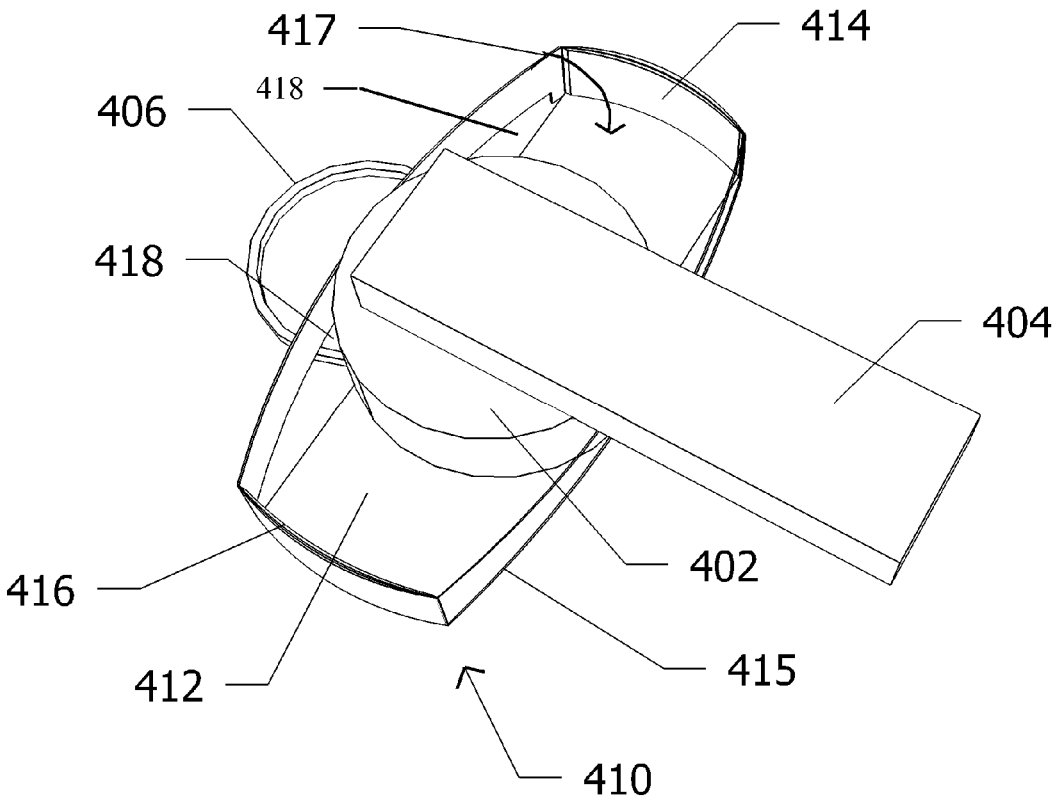
Figure 22:
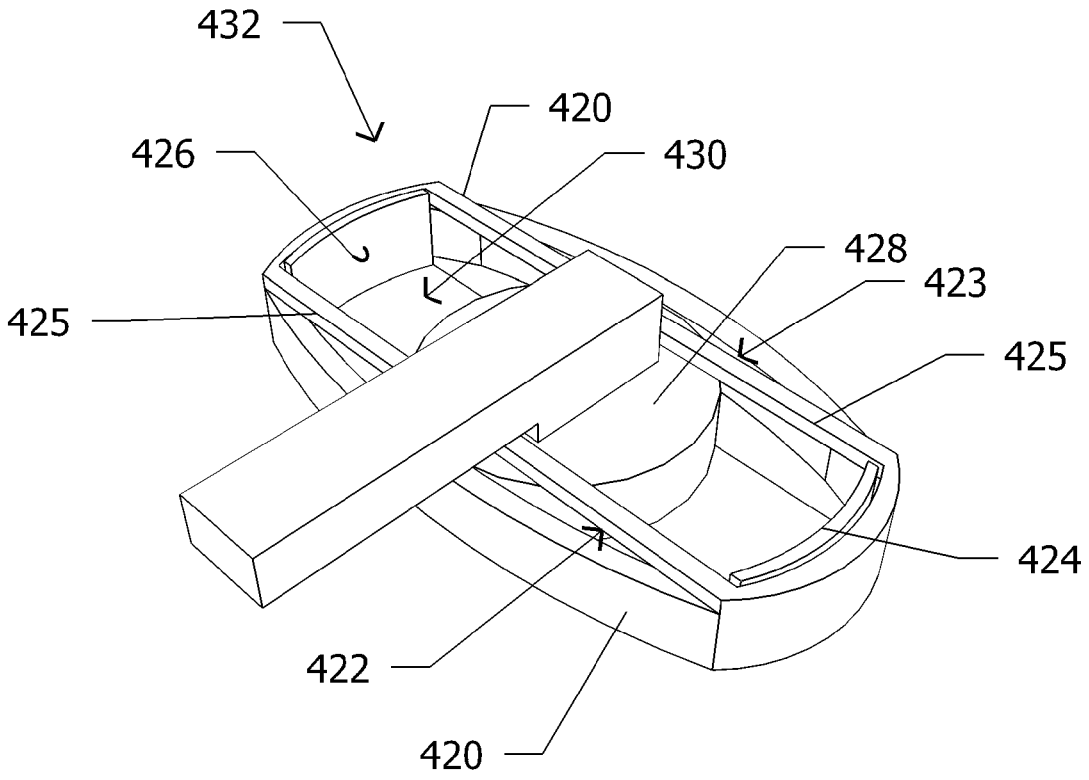
Figure 23:
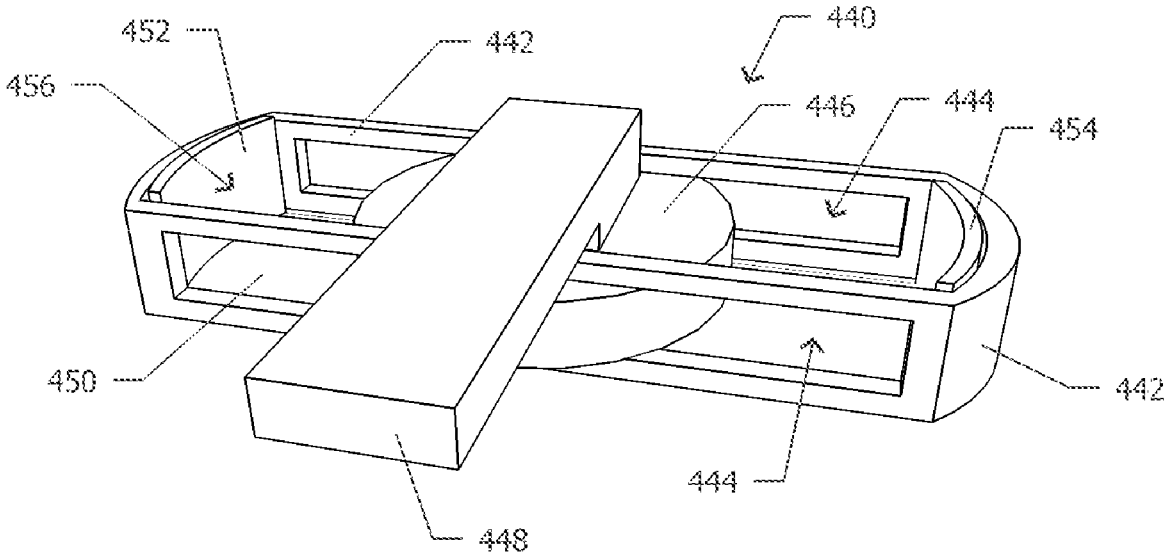

FIG. **6*a* is a perspective view of another embodiment of a flexible member configured to stretch around the sides walls shown in FIGS. 1-4**;

FIGS. 7A-7D illustrate a clip configured to couple to the universal ear-bud holder shown in FIG. 5;

FIG. 7E illustrates clips coupled together in accordance with a feature of the present invention;

FIG. 8 is a perspective view of a universal ear-bud holder configured in accordance with another embodiment of the present invention;

FIG. 9 is a perspective view of a universal ear-bud holder configured in accordance with another embodiment of the present invention;

FIG. 10 is a perspective view of a universal ear-bud holder configured in accordance with another embodiment of the present invention;

FIG. 11 is a perspective view of a universal ear-bud holder configured in accordance with another embodiment of the present invention;

FIG. 12 is a perspective view of a universal ear-bud holder configured in accordance with another embodiment of the present invention;

FIG. 13 is a perspective view of the universal ear-bud holder shown in FIG. 12, wherein an ear-bud is being retained within the universal ear-bud holder;

FIG. 14 is a perspective view of the universal ear-bud holder shown in FIGS. 12 and 13, wherein a boom of a wireless ear-bud is being retained within the universal ear-bud holder;

FIG. 15 is a perspective view of a universal ear-bud holder configured in accordance with another embodiment of the present invention;

FIG. 16 is a perspective view of the universal ear-bud holder shown in FIG. 15, wherein an ear-bud is shown being retained by the universal ear-bud holder;

FIG. 17 is a perspective view of a plug for holding a universal ear-bud holder configured in accordance with another embodiment of the present invention;

FIG. 18 is a perspective view of a plug for holding a universal ear-bud holder configured in accordance with another embodiment of the present invention;

FIG. 19 is a perspective view of a plug for mounting a universal ear-bud holder configured in accordance with the present invention;

FIG. 20 is a perspective view of a prior-art wireless ear-bud having a ring on the ear-bud;

FIG. 21 is a perspective view of the ear-bud shown in FIG. 20 being retained within a universal ear-bud holder configured in accordance with the present invention;

FIG. 22 is a perspective view of a universal ear-bud holder configured in accordance with another embodiment of the present invention; and FIG. 23 is a perspective view of a universal ear-bud holder configured in accordance with another embodiment of the present invention.

DETAILED DESCRIPTION OF THE PREFERRED EMBODIMENTS

Figure 1:
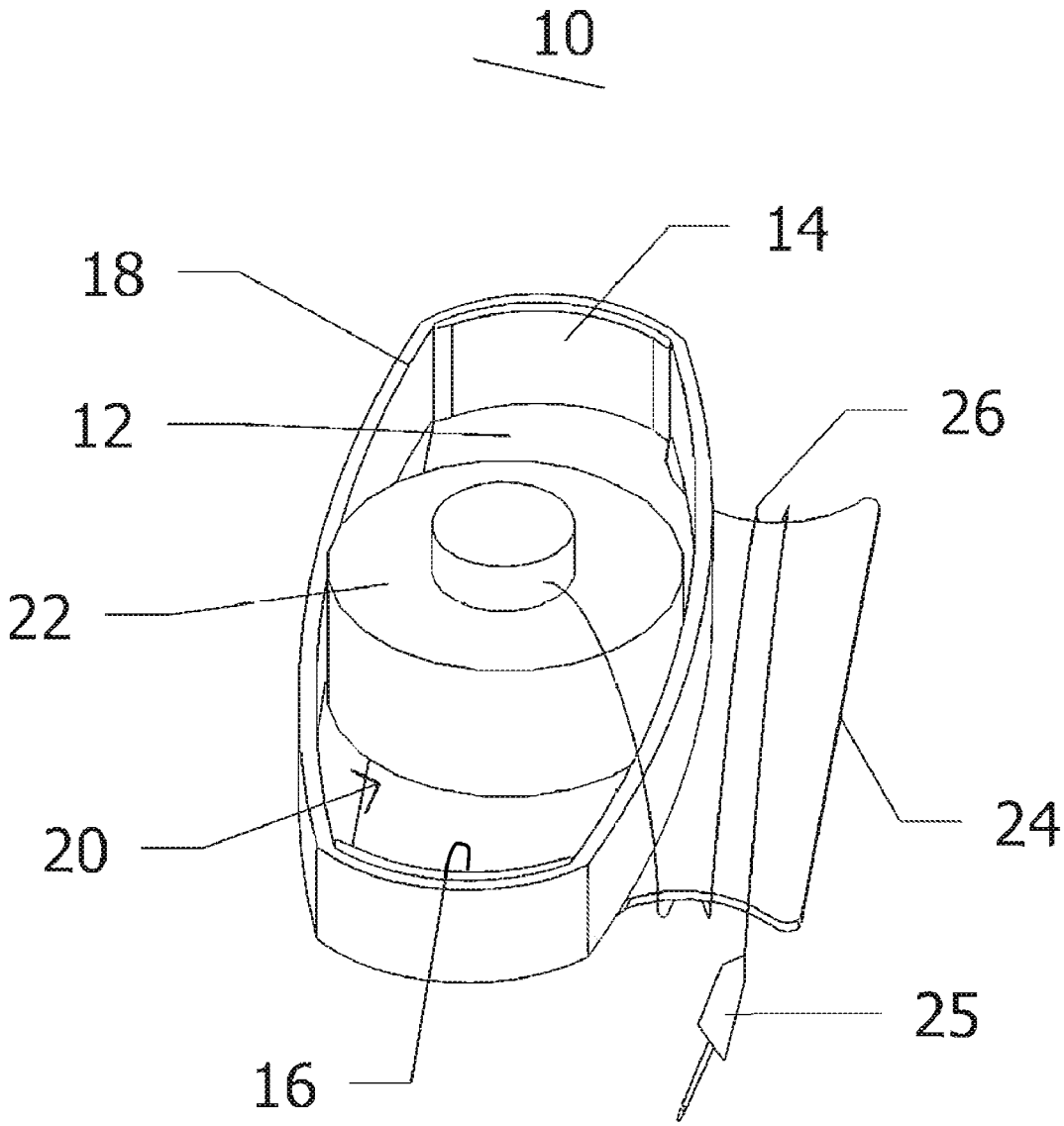
FIG. 1 is a perspective view of a universal ear-bud holder configured in accordance with a preferred embodiment of the present invention.

Referring now to the drawings, FIG. 1 is a perspective view of a universal ear-bud holder 10 configured in accordance with a preferred embodiment of the present invention. The universal ear-bud holder 10 includes a base 12 having first and second sidewalls 14,16. A receptacle 20 is formed by the base 12 and attached first and second sidewalls 14,16. A flexible member or flexible band 18 is attached to the sidewalls 14,16. The flexible member 18 is preferably constructed of a silicon or rubber material, such as a rubber band, which is stretched around the sidewalls 14,16. The flexible member 18 may be attached to the sidewalls 14,16 by using an adhesive. However, an adhesive is not necessary as the flexible member 18 can be attached to the sidewalls 14,16 by simply stretching the flexible member 18 around the sidewalls 14,16. A wired ear-bud 22 is shown being retained within the receptacle 20 of the universal ear-bud holder 10. The flexible member 18 stretches to accommodate and restrain the ear-bud 22 located within the receptacle 20.

In accordance with an object of the present invention, the flexible band 18 enables the universal ear-bud holder 10 to accommodate and retain ear-buds of varying sizes and shapes. Regardless of the size and shape of an ear-bud, the flexible band 18 of the universal ear-bud holder 10 can stretch to receive and contract to securely retain an ear-bud having multiple configurations and sizes.

In accordance with another aspect of the present invention, wires of a wired ear-bud can be neatly stored for later use. The universal ear-bud holder 10 includes an extension or bracket 24 attached to the base 12. The bracket 24 is preferably molded out of the same unitary piece of plastic as the base 12, but the bracket 24 can be a separate piece that is glued or attached in a conventional manner to the base 12. The base 12, sidewalls 14,16, and bracket 24 are preferably formed out a unitary, rigid plastic or other polymer, but may be separate elements that are all attached together in a conventional manner. The base 12 can also be formed out of other rigid materials such as wood, glass or metal. Of course, the base 12 can be formed out of a hard flexible material, as long as the base 12 is capable of maintaining its shape when the flexible member 18 is stretched around the sidewalls 14,16.

The wired ear-bud 22 includes a wire 26 having an ear-phone plug 25 which is sized to fit into an ear-phone socket of an electronic device. The wire 26 is neatly retained by the universal ear-bud holder 10 by wrapping the wire 26 around the bracket 24. In this manner, the universal ear-bud holder 10 can accommodate and retain wired ear-buds having connecting wires of varying lengths and sizes. Of course, it can be appreciated the universal ear-bud holder 10 can also easily retain wireless ear-buds.

Figure 2:
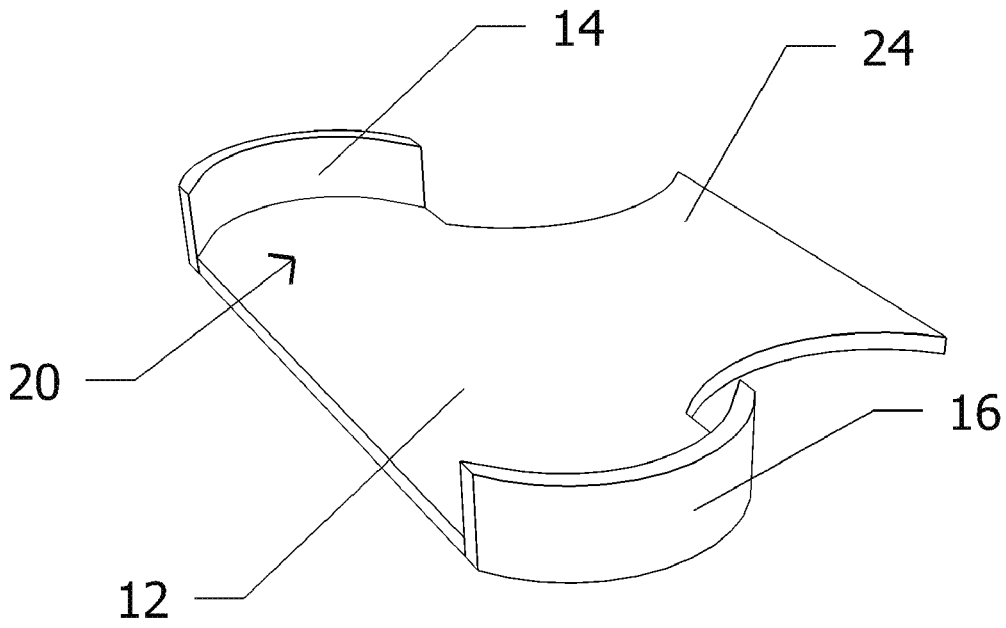
FIG. 2 is a perspective view of a base and sidewalls for the universal ear-bud holder shown in FIG. 1.

FIG. 2 illustrates the base 12, sidewalls 14,16, and bracket 24 of the universal ear-bud holder 10. The flexible member 18 is not illustrated to more easily show the preferably rigid base 12 and attached sidewalls 14,16 that form a receptacle 20. The bracket 24 is preferably formed from the same unitary piece of the base 12 also is illustrated. While the base 12 is preferably constructed of a rigid material, such as plastic or metal, it is possible for the base to be constructed of a slightly flexible material such as hard rubber. The base 12 may be flexible, but needs to be rigid enough to support the force being asserted by the flexible member 18 around the sidewalls 14, 16.

Figure 3:
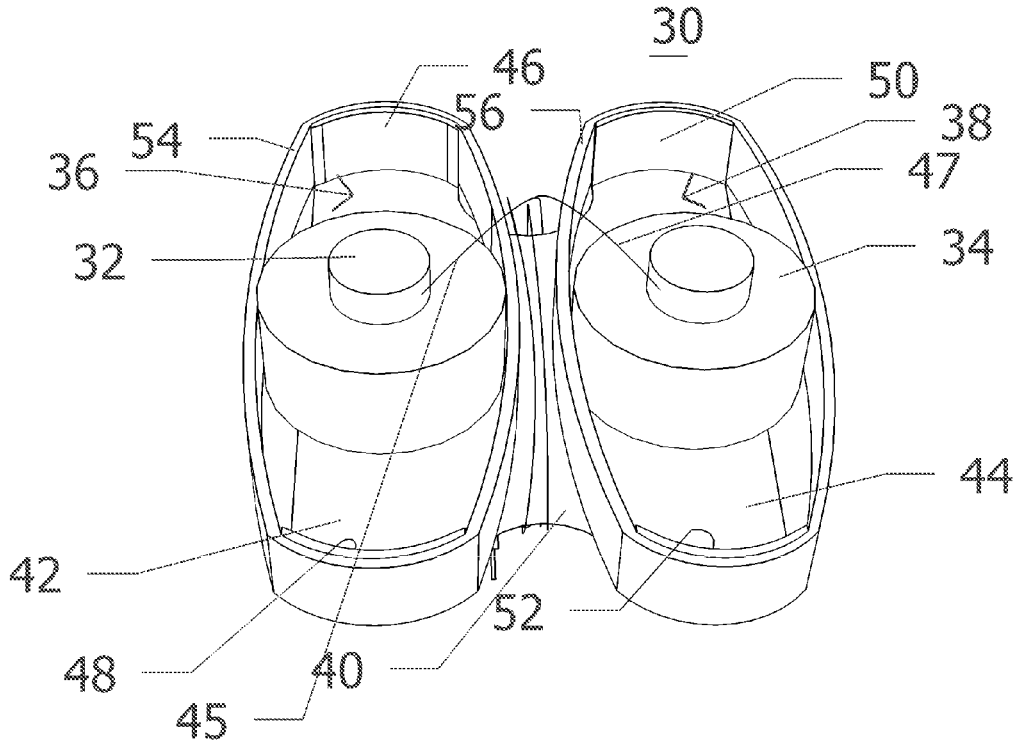
FIG. 3 is a perspective view of a universal ear-bud holder configured in accordance with another embodiment of the present invention.

FIG. 3 illustrates another embodiment of a universal ear-bud holder 30 configured in accordance with the present invention. The universal ear-bud holder 30 is similar to the design shown in FIG. 1, except that the universal ear-bud holder 30 shown in FIG. 3 is adapted to hold at least two ear-buds 32,34. It can be appreciated that it is possible to store more than one ear-bud in the receptacle 20 of ear-bud holder 10 in FIG. 1, and more than one ear-bud in each of the receptacles 36,38 in the universal ear-bud holder 30 shown in FIG. 3.

The universal ear-bud holder 30 has two bases 42, 44 connected by a bracket 40. The bases 42, 44 and bracket 40 are preferably formed from the same unitary piece of rigid plastic, but these may be separate elements that are fastened together in a conventional manner, such as gluing or welding. While plastic is the preferred construction material for the base, metal, wood or other suitable material can be used. Furthermore, similar to the universal ear-bud holder 10 shown in FIG. 1, the universal ear-bud holder 30 shown in FIG. 3 may be constructed of a slightly flexible material, such as hard rubber.

Figure 4:
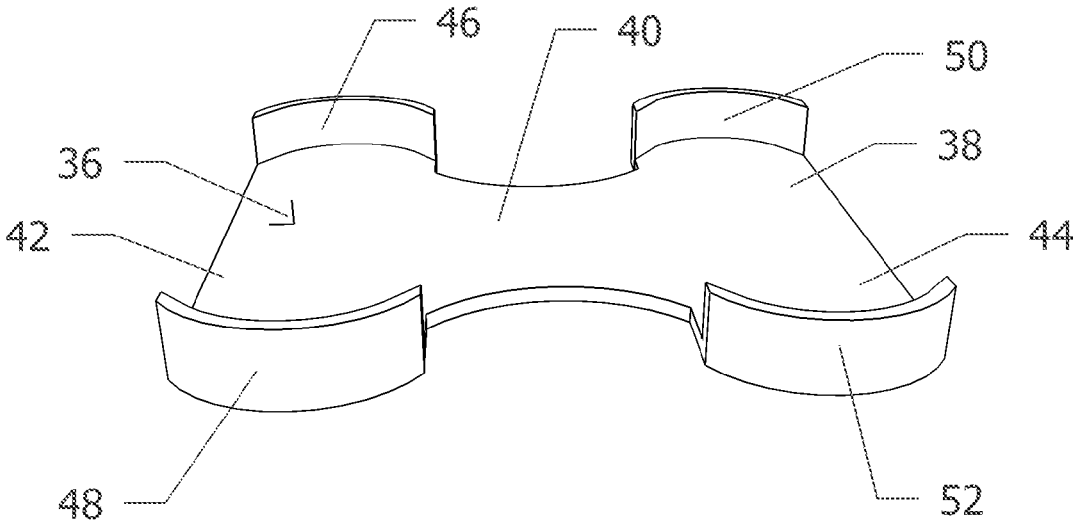
FIG. 4 is a perspective view of a base and sidewalls for the ear-bud holder shown in FIG. 3.

Similar to the universal ear-bud holder 10, the universal ear-bud holder 30 in FIG. 3 has first and second sidewalls 46, 48 attached to base 42, and first and second sidewalls 50,52 attached to base 44. A flexible member or elastic band 54 is stretched around sidewalls 46,48 of the base 42, and a flexible member 56 is stretched around sidewalls 50,52 of base 44. Wires 45,47, attached to ear-buds 32,34, respectively, are wrapped around the bracket 40. An ear-bud 32 is inserted into the receptacle 36 by hand while stretching the flexible member 54 which secures the ear-bud 32 within the receptacle 36. Similarly, ear-bud 34 is inserted into receptacle 38 while stretching the flexible member 56 around the ear-bud 34 to hold the ear-bud 34 in place. In this manner, multiple ear-buds of varying sizes and configurations can be retained within the universal ear-bud holder 30. Of course, wireless ear-buds are retained in the same manner FIG. 4 shows the bases 42,44, sidewalls 46,48,50,52, receptacles 36,38, and bracket 40. The flexible members 54,56 and ear-buds 32,34 are not shown so the previously identified elements are more easily illustrated.

FIG. 5 shows bases 52,54 connected by a bracket 65 pursuant to another embodiment of the present invention. The universal ear-bud holder 51 is similar to the universal ear-bud holder 30 shown in FIG. 3, with the addition of posts 64,66, 68,70 on side walls 56,58, 60, 62 respectively, and apertures 72,74 on bases 52,54, respectively. Similar to the embodiments shown in FIGS. 1-4, the bases 52, 54 are preferably constructed of a rigid material such as plastic, metal or wood. However, the bases 52, 54 may be constructed of a less rigid material, such as hard rubber.

The base 52 includes sidewalls 56, 58 having posts 64, 66, respectively. Base 54 includes sidewalls 60, 62 having post 68, 70, respectively. A receptacle 53 is defined by the base 52 and sidewalls 56, 58. Similarly, a receptacle 55 is defined by the base 54 and sidewalls 60,62. Apertures 72, 74 are located within the bases 52, 54, respectively, and are sized to receive a mounting post 82 of a clip 80 illustrated in FIG. 7.

Figure 6:
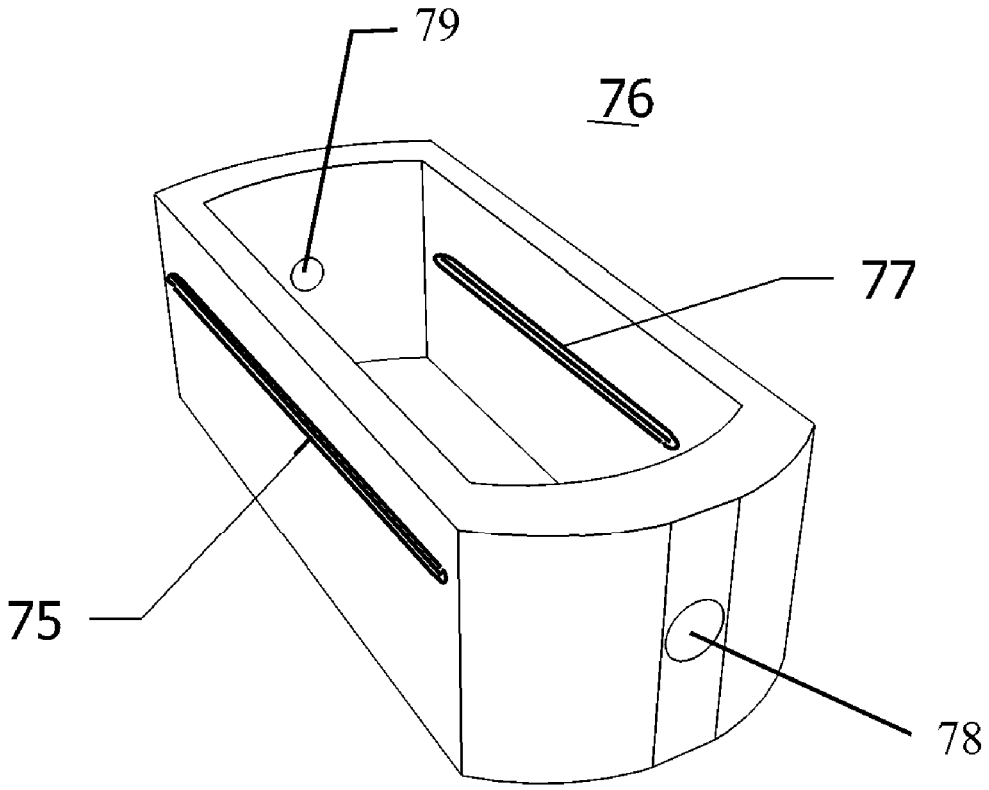
FIG. 6 is a perspective view of a flexible member configured to stretch around the sides walls shown in FIG. 5.

FIG. 6 shows a flexible member 76 shaped to stretch around the sidewalls 56,58 of base 52, and another flexible member 76 stretches around the sidewalls 60,62 of base 54. Apertures 78,79 in the flexible member 76 are sized to receive the posts 64,66, and posts 68,70 in another flexible member 76. The posts 64,66,68,70 prevent flexible members 76 from slipping off the sidewalls 56,58,60,62. The flexible member 76 is preferably constructed of silicon or another flexible material. The flexible member 76 is similar to a thick rubber band.

Figure 6A:
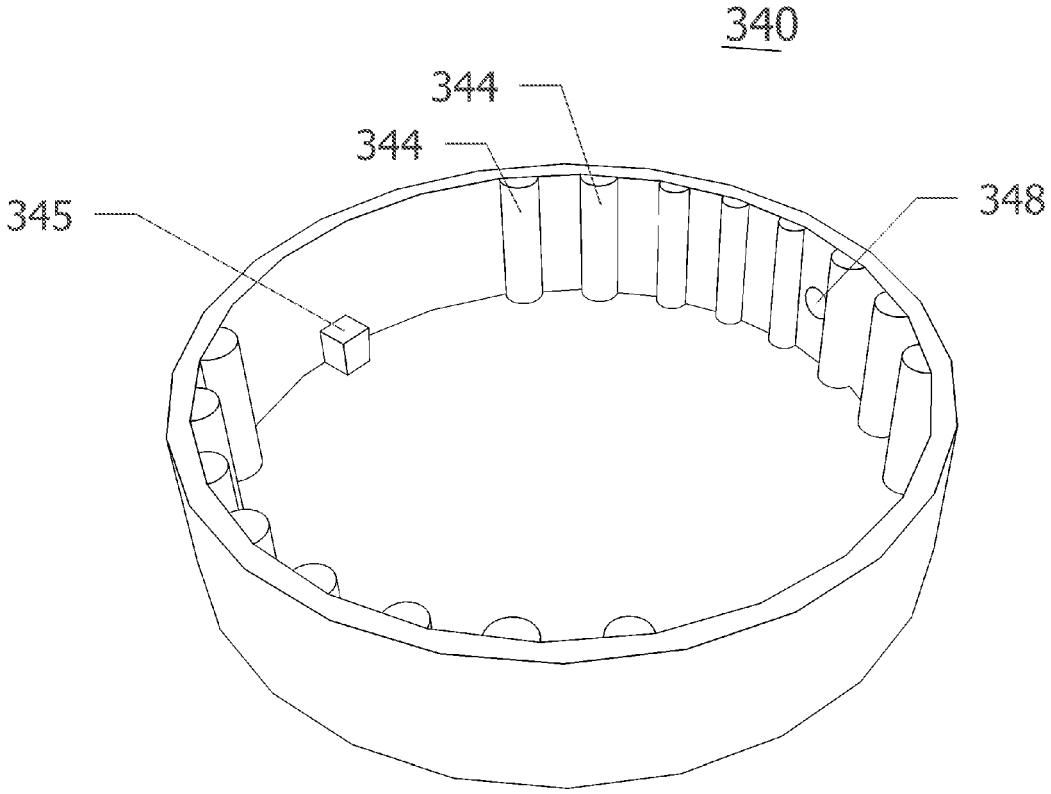

FIG. 6A illustrates a modified flexible member 340 for the universal ear-bud holders shows in FIGS. 1-4. The flexible member 340 is similar to the flexible member 18 shown in FIG. 1, except flexible member 340 includes raised ribs 344 on the inside of the flexible member 340. The raised ribs 344 are designed to be against the outside of the sidewalls 14,16 and assist in preventing the flexible member 340 from slipping off the sidewalls 14,16.

FIGS. 7A-7D illustrate a clip 80 to be attached to the universal ear-bud holder 51 shown in FIG. 5. The post 82 of the clip 80 fits into aperture 72 and/or 74 of the ear-bud holder 51. The post 82 includes a slit enabling the post 82 to contract while being inserted into the apertures 72, 74 of the bases 52, 54, and expand thereafter to secure the post 82 within the aperture 72 and/or 74. The clip 80 functions to secure the universal ear-bud holder 51 to a user's belt, shirt, or other clothing article. The clip 80 can also be used to secure the universal ear-bud holder 51 to a table, desk or other item. The clip 80 includes a hinge 84 connecting arms 81, 83. A conventional spring (not shown) is located within the hinge 84 to provide closing or binding tension on the arms 81, 83, enabling the clip 80 to attach to an article of clothing or a desk or other structure. The arms 81, 83 include saw tooth edges 85 enabling the clip 80 to more securely attach to various types of objects. The slot 86 in the clip 80 sized for receiving an arm of another clip as shown in FIG. 7.

FIG. 7E illustrates an arm 83 of a clip 80 fitting through a slot 86 of another clip 80. This design feature of the present invention enables multiple clips 80 to be combined or fitted together to enable a universal ear-bud holder 130 to be mounted to various objects of in various configurations. For example, the configuration shown in FIG. 7E is designed to secure a universal ear-bud holder 130 to one of the horizontal slats of a vent in an automobile dashboard. The universal ear-bud holder mounts to the clip 80 by inserting the post 82 through an aperture in the base of universal ear-bud holder 130, similar to the aperture 72 or 74 shown in FIG. 5. The illustrated universal ear-bud holder 130 has a base 131, sidewalls 132,134, and flexible member 136 for a receptacle 135. An ear-bud 101 having a boom 103 is shown being retained within the receptacle 135 of the universal ear-bud holder 132.

FIG. 8 shows a universal ear-bud holder 90 configured in accordance with another embodiment of the present invention. The ear-bud holder includes bases 92,94 having single sidewalls 95,97, respectively. A flexible member 93 is stretched around the sidewall 95, and a flexible member 99 is stretched around the sidewall 97. Receptacles 87, 89 are defined by the single sidewalls 95, 97, bases 89, 92, and flexible members 93, 99.

The sidewalls 95, 97 are preferably rigid, while the flexible members 93, 99 are flexible and capable expanding to receive an ear-bud within the receptacles 87,89. Since the flexible members 93, 99 are capable expanding to receive and secure ear-buds, and the sidewalls 95, 97 are rigid and designed not to readily expand, the expandable members 93, 99 are constructed of a flexible polymer or rubber and are secured to the ends of the sidewalls 95, 97 by friction from stretching, or if necessary, known adhesive or other bonding techniques. The flexible members 93, 99 enable the universal ear-bud holder 90 to receive and retain ear-buds of varying sizes and configurations. While each of the receptacles 87, 89 are preferably designed to receive an individual ear-bud, the universal ear-bud holder 90 is capable of receiving multiple ear-buds within each of the receptacles 87, 89 if desired. A bracket 96 attaches the bases 92, 94 and corresponding receptacles 87, 89.

FIG. 9 shows a universal ear-bud holder 250 of the present invention having a single wall 251 connected to a base 252. The base 252 and single sidewall 251 are preferable constructed of a single, rigid material, such as plastic, but may be composed of separate elements that are secured together. The single wall 251 has a semicircle configuration, and the base 252 has a half-moon configuration. A flexible member 254 is stretched around the single wall 251. The flexible member 254 includes slits 253 which allow end posts 256,258 of the single sidewall 251 pass through to secure the flexible member 254 to the sidewall 251.

A wireless ear-bud 260 having a boom 262 is shown being retained within the receptacle 261 formed by the single sidewall 251 and the base 252. The ear-bud 260 is inserted into the receptacle 261 by stretching out the flexible band 254 and placing the ear-bud 260 into the receptacle 261. The flexible band 254 is then released, and the flexible band 254 contracts to secure the ear-bud 260 within the receptacle 261.

FIG. 10 shows a universal ear-bud holder 265 which has a similar half-moon base 252 and semicircle single sidewall 251, except the flexible member 267 does not extend around the single sidewall 251. Rather, the opposing ends of the flexible member 267 are each attached to end posts 256,258 on the single sidewall 251. The flexible member 267 is attached to the end post 256, 258 by including slits 257 in ends of the flexible member 267 which allow the end posts to pass through the ends of the flexible member 267 and secure the flexible member 267 to the sidewall 251. An ear-bud 260 is inserted and secured within the receptacle 261 in the same manner as described in regard to FIG. 9.

FIG. 11 shows a universal ear-bud holder similar to that shown in FIGS. 9 and 10, except the flexible member 277 is a strip, not a circular band, that includes a "T" formed into the ends 275 of the flexible band 277. The flexible band 277 fits into slots in the ends 256 of single sidewall 251, and the T formed on the ends 275 of the flexible member 277 prevent the ends of the flexible member 277 from slipping through the slots 273 in the single sidewall 251.

FIGS. 12-14 show a universal ear-bud holder 100 constructed in accordance with a further embodiment of the present invention. The universal ear-bud holder 100 is constructed of a rigid U-shaped base 104 forming a receptacle 102. The base 104 is preferably constructed of a rigid material, such are metal or plastic. However, the U-shaped base 104 may be constructed of a slightly flexible material, such as hard rubber. A flexible member 106, such as a rubber band, is attached to the U-shaped base 104. The flexible member 106 can be attached to the base 104 by stretching the rubber band 106 around the U-shaped base 104, and thereby attached to the U-shaped base without the use of any adhesive. Of course, an adhesive may be used to prevent the flexible member 106 from sliding off or otherwise being removed from the U-shaped base 104.

The universal ear-bud holder 100 also may include an apparatus for attaching the universal ear-bud holder 100 to the belt of a user, or even a desk or table. A clip 108 is shown attached to the rubber band 106 by an adhesive as an example of an apparatus for securing the universal ear-bud holder 100. In another embodiment the clip can be attached to the U-bar 104 through an aperture in the flexible band 106. The clip 108 can be used to secure the universal ear-bud holder to a user's belt.

FIG. 13 illustrates the universal ear-bud holder 100 housing a wireless ear-bud by locating the ear-bud 101 within the receptacle 104. FIG. 14 illustrates the wireless ear-bud 101 having a boom 103 being retained within the receptacle 104. The flexible member 106 is capable of stretching to accommodate ear-buds of different sizes and configuration. The boom 103 is being retained within the receptacle 104 of the universal ear-bud holder 100 by the flexible member 106. The flexible member 106 enables the universal ear-bud holder 100 to adjust to booms of different sizes and shapes, and still retain a boom securely within the receptacle 104 of the U-bar 104. Accordingly, it can be appreciated that the ear-bud holder 100 is capable of retaining ears-bud of multiple configurations, and by securing either the ear-bud itself or the boom of the ear-bud.

FIGS. 15 and 16 illustrate a universal ear-bud holder 110 configured in accordance with another embodiment of the present invention. The universal ear-bud holder 110 includes a base 111 having sidewalls 113,114, forming a U-bar and defining a receptacle 115. A flexible member 112 is stretched around the sidewalls 113, 114. The flexible member 112 is attached to the sidewalls 113, 114 by conventional bonding or adhesive techniques, or simply by stretching the flexible member 112 around the sidewalls 113, 114. A clip 116 is attached to the base 111 by gluing or other conventional bonding techniques.

FIG. 16 shows an ear-bud 101 located within the receptacle 115 of the universal ear-bud holder 110. The ear-bud 101 includes a boom 103. The flexible member 112 stretches around the ear-bud 101 to securely retain the ear-bud 101 within the universal ear-bud holder 110.

FIG. 17 illustrates a mounting plug 270 sized to be inserted into an ear phone aperture of an electronic apparatus. The mounting plug 270 includes a shaft 272 having a tapered front end 274. A platform or stop back 276 is located at the rear end of the shaft 272. The platform 276 has a larger diameter than the shaft 272 in order to function as a stop plate wherein the shaft 272 is inserted into the earpiece receptacle of an electronic device. A handle 278 is attached to the platform 276 to enable an arm of a clip to be inserted through for securing or mounting a universal ear-bud holder, similar to that shown in FIG. 19. The handle 278 could also be used to enable a necklace or other mounting apparatus to be secured to the mounting plug 270. The mounting plug 270 is constructed of a non-electrically conductive material to avoid interfering with the electronic functionality of the electronic device whose ear phone receiving aperture is holding the mounting plug 270.

FIG. 18 illustrates a mounting plug 280 configured in accordance with an embodiment of the present invention. The mounting plug 280 is similar to the design shown in FIG. 17, except the shaft 281 has larger diameter locations 282 and smaller diameter locations 284. The varying diameters of the shaft 281 enable the shaft 281 to be more firmly secured within an earphone plug receiving port of an electronic apparatus. The mounting plug 280 includes a platform 286 having a handle 288.

FIG. 19 illustrates a mounting plug 300 configured in accordance with the present invention. The mounting plug 300 is constructed of electrically non-conductive material and includes a shaft 302, stop plate 304 and handle 306. The shaft 302 is sized to be inserted into a mini USB socket of an electronic device. However, the mounting plug 300, in accordance with the present invention, can be sized to fit into any version of a USB socket.

FIG. 20 illustrates a conventional wireless ear-bud 402 having a boom 404 and a ring 406 attached to the ear-bud 402. The ring 406 is included on the ear-bud 402 to enable the ear-bud 402 to more securely fit within a user's ear.

FIG. 21 shows the ear-bud 402 having ring 406 being retained within a universal ear-bud holder 410 configured in accordance with another embodiment of the present invention. Similar to the embodiment shown in FIG. 1, the ear-bud holder 410 has a base 412 with sidewalls 414,416 attached to opposing ends of the base. A flexible member 415 is stretched around the sidewalls 414,416 in order to attach to the sidewalls 414,416. The flexible member 415 stretches to receive the ear-bud 402 in the receptacle 417 formed by the base 412 and sidewalls 414,416. The flexible member 415 contracts to retain the received ear-bud 402 within the receptacle 417.

In accordance with the embodiment illustrated in FIG. 21, a cutout 418 in the flexible member 415 enables the ring 406 to protrude from the universal ear-bud holder 410 without obstruction and further secures the ear-bud 402 within the universal ear-bud holder 410.

FIG. 22 illustrates a universal ear-bud holder similar to the configuration shown in FIG. 1, except the flexible member 420 includes slits 422 and 423 in the flexible member 420 between the first and second sidewalls 424,426. The slit 422 enables a top portion 425 of the flexible member 420 to come over the back of the ear-bud 428 and further secure the ear-bud 428 within the receptacle 430 of the ear-bud holder 432. The flexible member 76 shown in FIG. 6 includes slits 75 and 77 that are designed to function similarly to the slits 422 and 423 in the flexible member 420 shown in FIG. 22.

FIG. 23 illustrates a universal ear-bud holder 440 configured in accordance with another embodiment of the present invention. The embodiment illustrated in FIG. 23 is similar to the embodiment shown in FIG. 1, except the flexible member 442 includes slots or openings 444 enabling an ear-bud 446 of a wireless ear-bud to extend unobstructed through the flexible member 442. The illustrated ear-bud 446 is wireless and includes a boom 448, but the illustrated embodiments also can accommodate a wired ear-bud. Similar to the embodiment shown in FIG. 1, the universal ear-bud holder 440 includes a base 450 having sidewalls 452, 454. The flexible member or band 442 stretches around the sidewalls 432,434 to further form a receptacle 456 for receiving an ear-bud. The ear-bud 446 passes through openings 444 in the flexible member 442 to more firmly secure the ear-bud 446 within the receptacle 456 of the ear-bud holder 440.

Obviously many modifications and variations of the present invention are possible in the light of the above teachings. It is therefore to be understood that within the scope of the appended claims the invention may be practiced otherwise than as specifically described.

I claim as my invention:

1. An apparatus for retaining an ear-bud, comprising:

a first planar base;

a second planer base;

a bracket located between and connected to the first and the second planar base, wherein the first and the second planar base are in one dimensional plane;

a first and second sidewall rigidly and directly connected to opposing ends of the first planar base, wherein the first and the second sidewall are perpendicular to the first planar base and form a first receptacle between the first and the second sidewall for receiving an ear-bud;

a first flexible member stretched around and outer surface of the first and the second sidewall, wherein the first flexible member stretches and contracts to enable the apparatus to receive and retain, within the first receptacle, ear-buds having various configurations;

a first and second post attached to the outer surface of the first and the second sidewall, respectively, and a first and second aperture in the first flexible member sized for receiving the first and the second post, respectively, wherein the first and the second post are inserted into the first and the second aperture, respectively, to aid in preventing the first flexible member from slipping off the first and the second sidewall;

a third and fourth sidewall rigidly and directly connected to opposite ends of the second planar base, wherein the third and the fourth sidewall are perpendicular to the second planar base and form a second receptacle between the third and the fourth sidewall for receiving an ear-bud;

a second flexible member stretched around and outer surface of the third and the fourth sidewall, wherein the second flexible member stretches and contracts to enable the apparatus to receive and retain, within the second receptacle, ear-buds having various configurations; and a third and a fourth post attached to the outer surface of the third and the fourth sidewall, respectively, and a third and a fourth aperture in the second flexible member sized for receiving the third and fourth post, respectively, wherein the third and the fourth post are inserted into the third and the fourth aperture respectively, to aid in preventing the second flexible member from slipping off the third and the fourth sidewall.

2. The apparatus of claim 1, wherein the first and the second planar base are constructed of a magnetic material, thereby enabling the apparatus to retain an ear-bud containing metal within the first and the second receptacle via a magnetically attractive field.

3. The apparatus of claim 1, wherein the first and the second sidewall are constructed of magnetic material, thereby enabling the apparatus to retain an ear-bud containing metal within the first and the second receptacle via a magnetically attractive field.

4. The apparatus of claim 1, further comprising:

a sensing circuit within the first receptacle to alert a user of the apparatus when an ear-bud is removed from the first receptacle.

5. The apparatus of claim 1, wherein a clip is rotatably mounted to the first planar base.

6. The apparatus of claim 5, wherein the clip includes a post and the first planar base includes an aperture sized to receive the post, and the clip is rotatably mounted to the first planar base by inserting the post into the aperture in the first planar base.

7. The apparatus of claim 1, further comprising a clip directly connected to the first planar base.

8. The apparatus of claim 7, wherein the clip is a closed-pin having two arms connected by a spring.

9. The apparatus of claim 1, wherein the bracket is planar, and the first planar base, the second planar base, and the bracket are all in the same dimensional plane.

10. the apparatus of claim 1, wherein the first and the second sidewall are parallel to each other, and the third and the fourth sidewall are parallel to each other.

11. The apparatus of claim 1, wherein the first post and the second post extend perpendicular to the outer surfaces of the first sidewall and the second sidewall, respectively, and the third post and the fourth post extend perpendicularly to the outer surfaces of the third sidewall and the fourth sidewall, respectively.

12. An apparatus for retaining an ear-bud, comprising:

a first base;

a second base;

a bracket located between and connected to the first and the second base;

a first and second sidewall rigidly and connected directly to opposing ends of the first base, wherein the first and the second sidewall are perpendicular to the first base and parallel to each other;

a first flexible member stretched around an outer surface of the first and the second sidewall to for a first receptacle, wherein the first flexible member stretches and contracts to enable the apparatus to receive and retain, within the first receptacle, ear-buds having various configurations;

a first and second post attached perpendicular to the outer surface of the first and the second sidewall, respectively, and a first and a second aperture in the first flexible member sized for receiving the first and the second post, respectively, wherein the first and the second post are inserted into the first and second aperture, respectively, to aid in preventing the first flexible member from slipping off the first and the second wall;

a third and fourth sidewall rigidly and connected directly to opposing end of the second base, wherein the third and the fourth sidewall are perpendicular to the second base and parallel to each other;

a second flexible member stretched around the outer surface of the third and the fourth sidewall to form a second receptacle, wherein the second flexible member stretches and contracts to enable the apparatus to receive and retain, within the second receptacle, ear-buds having various configurations; and a third and fourth post attached perpendicular to the outer surface of the third and the fourth sidewall, respectively, and a third and a fourth aperture in the second flexible member sized for receiving the third and the fourth post, respectively, wherein the third and the fourth post are inserted into the third and the fourth aperture, respectively, to aid in preventing the second flexible member from slipping off the third and the fourth sidewall.

13. The apparatus of claim 12, wherein the first base and the second base are planar.

14. The apparatus of claim 13, wherein the first planar base and the second planar base are in the same dimensional plane.

15. The apparatus of claim 12, further comprising:

a clip having a post, wherein the first base includes an aperture sized for receiving the post, and he clip is rotatably coupled to the first base by inserting the post in the aperture in the first base.

16. The apparatus of claim 15, wherein the post in the clip includes a slot enabling the diameter of the post to be decreased by compressing the post and thereby more easily inserted into the aperture in the first base.

* * * * *